US011621010B2

(12) United States Patent
Sugiura et al.

(10) Patent No.: US 11,621,010 B2
(45) Date of Patent: Apr. 4, 2023

(54) CODING APPARATUS, CODING METHOD, PROGRAM, AND RECORDING MEDIUM

(71) Applicant: NIPPON TELEGRAPH AND TELEPHONE CORPORATION, Chiyoda-ku (JP)

(72) Inventors: Ryosuke Sugiura, Atsugi (JP); Yutaka Kamamoto, Atsugi (JP); Takehiro Moriya, Atsugi (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 194 days.

(21) Appl. No.: 16/971,977

(22) PCT Filed: Feb. 19, 2019

(86) PCT No.: PCT/JP2019/005947

§ 371 (c)(1),
(2) Date: Aug. 21, 2020

(87) PCT Pub. No.: WO2019/167706

PCT Pub. Date: Sep. 6, 2019

(65) Prior Publication Data

US 2020/0402524 A1 Dec. 24, 2020

(30) Foreign Application Priority Data

Mar. 2, 2018 (JP) ..... JP2018-037313

(51) Int. Cl.
*G10L 19/035* (2013.01)

(52) U.S. Cl.
CPC ..... *G10L 19/035* (2013.01)

(58) Field of Classification Search
CPC ..... G10L 19/035
See application file for complete search history.

(56) References Cited

U.S. PATENT DOCUMENTS 10,515,643 B2 * 12/2019 Moriya ..... G10L 19/008
2009/0248424 A1 * 10/2009 Koishida ..... G10L 19/24 704/503

FOREIGN PATENT DOCUMENTS

JP 2013174689 A * 9/2013
WO WO-2012110480 A1 * 8/2012 ..... G10K 11/16

OTHER PUBLICATIONS

International Search Report dated Apr. 9, 2019 in PCT/JP2019/005947 filed Feb. 19, 2019.

(Continued)

*Primary Examiner* — Anne L Thomas-Homescu
(74) *Attorney, Agent, or Firm* — Oblon, McClelland, Maier & Neustadt, L.L.P.

(57) ABSTRACT

Efficient assignment of bit numbers is performed even under a low bit rate condition. A quantizer 12 obtains a quantized spectral sequence from a frequency spectral sequence. An integer transformer 13 obtains a unified quantized spectral sequence by obtaining, by a bijective transformation, a transformed integer for each of the sets, each being made up of integer values, obtained from the quantized spectral sequence. An integer encoder 15 obtains an integer code by encoding the unified quantized spectral sequence using a bit assignment sequence. An object-to-be-encoded estimator 18 obtains an estimated unified spectral sequence from the frequency spectral sequence by a transformation which is performed by the integer transformer 13 or a transformation that approximates the magnitude relationship between values before and after the above transformation. A bit assigner 14 obtains a bit assignment sequence and a bit assignment code from the estimated unified spectral sequence. A quantization step size obtainer 11 obtains a quantization step size from the estimated unified spectral sequence and the bit assignment sequence.

7 Claims, 10 Drawing Sheets

(56) References Cited

OTHER PUBLICATIONS

R. Zelinski et al., "Adaptive Transform Coding of Speech Signals," in IEEE Transactions on Acoustics, Speech, and Signal Processing, vol. ASSP-25, No. 4, Aug. 1977, pp. 299-309.

* cited by examiner

CODING APPARATUS, CODING METHOD, PROGRAM, AND RECORDING MEDIUM

TECHNICAL FIELD

The present invention relates to a technique of quantizing and encoding a sample sequence derived from a frequency spectrum of an audio signal in signal processing techniques such as an audio signal encoding technique.

BACKGROUND ART

Conventionally, for compression encoding of a sample sequence of a time series signal or the like, variance or the like of the sample sequence is estimated and appropriate bit number assignment is performed based thereon. In this way, efficient compression encoding is performed such that distortion in a decoded signal is lessened with a small code amount. As a conventional technique of compression encoding of a sample sequence of an audio signal such as a speech signal or an acoustic signal, there is a technique of Non-patent Literature 1.

FIG. 1 is a functional configuration diagram of an encoder of Non-patent Literature 1. The encoder of Non-patent Literature 1 includes: a frequency domain transformer 10 that transforms, on an individual frame, which is a predetermined time segment, basis, a sample sequence of an input audio signal to a frequency spectral sequence $X_0, X_1, \ldots, X_{N-1}$ (N is the number of samples of a frequency domain sequence and is a positive integer); a bit assigner 14 that obtains, from the frequency spectral sequence $X_0, X_1, \ldots, X_{N-1}$, a bit assignment sequence $B_0, B_1, \ldots, B_{N-1}$, which is a sequence of bit numbers $B_0, B_1, \ldots, B_{N-1}$ to be assigned to the samples, and a bit assignment code Cb with a predetermined bit number corresponding to the bit assignment sequence $B_0, B_1, \ldots, B_{N-1}$; a quantization step size obtainer 11 that obtains, using the energy or the like of a sequence based on the frequency spectral sequence $X_0, X_1, \ldots, X_{N-1}$, a quantization step size s and a quantization step size code CQ with a predetermined bit number, which is a code corresponding to the quantization step size s; a quantizer 12 that obtains a quantized spectral sequence $\hat{X}_0, \hat{X}_1, \hat{X}_{N-1}$ which is a sequence of integer portions of the results obtained by dividing the samples of the frequency spectral sequence $X_0, X_1, \ldots, X_{N-1}$ by the quantization step size s; an integer encoder 15 that obtains a signal code CX by performing encoding on a sample-by-sample basis by assigning a bit number to each sample of the quantized spectral sequence $\hat{X}_0, \hat{X}_1, \ldots, \hat{X}_{N-1}$ in accordance with the value, which corresponds to the sample, of the bit assignment sequence $B_0, B_1, \ldots, B_{N-1}$; and a multiplexer 16 that obtains an output code of the encoder by multiplexing the bit assignment code Cb, the signal code CX, and the quantization step size code CQ.

FIG. 2 is a functional configuration diagram of a decoder of Non-patent Literature 1. The decoder of Non-patent Literature 1 includes: a demultiplexer 20 that obtains the output code output from the encoder as an input code and outputs the quantization step size code CQ contained in the input code to an inverse quantizer 24, the bit assignment code Cb contained in the input code to a bit assignment decoder 21, and the signal code CX contained in the input code to an integer decoder 22; the bit assignment decoder 21 that obtains the bit assignment sequence $B_0, B_1, \ldots, B_{N-1}$ corresponding to the bit assignment code Cb; the integer decoder 22 that obtains the value of each sample of the quantized spectral sequence $\hat{X}_0, \hat{X}_1, \ldots, \hat{X}_{N-1}$ by decoding the signal code CX for each bit number corresponding to one of the values of the bit assignment sequence $B_0, B_1, \ldots, B_{N-1}$; the inverse quantizer 24 that obtains the quantization step size s by decoding the quantization step size code CQ and obtains, as a decoded frequency spectral sequence $XD_0, XD_1, \ldots, XD_{N-1}$, a sequence of values which are obtained by multiplying the values of the samples of the quantized spectral sequence $\hat{X}_0, X_1, \ldots, \hat{X}_{N-1}$ by the quantization step size s; and a time domain transformer 25 that transforms the decoded frequency spectral sequence $XD_0, XD_1, \ldots, XD_{N-1}$ to an output signal which is a sample sequence of a time domain audio signal.

PRIOR ART LITERATURE

Non-Patent Literature

Non-patent Literature 1: R. Zelinski and P. Noll, "Adaptive transform coding of speech signals," in IEEE Transactions on Acoustics, Speech, and Signal Processing, vol. 25, no. 4, pp. 299-309, August 1977.

SUMMARY OF THE INVENTION

Problems to be Solved by the Invention

With the encoder and the decoder of Non-patent Literature 1, although it is possible to perform compression with less distortion under a high bit rate condition, compression efficiency is reduced under a low bit rate condition because only a bit number which is an integer value is assigned per frequency spectral sample, which undesirably increases distortion in a decoded sample sequence relative to an average bit number which is assigned to a sample sequence.

An object of the present invention is to make encoding and decoding with less distortion possible by performing efficient assignment of bit numbers even under a low bit rate condition.

Means to Solve the Problems

In order to solve the above-described problem, an encoder of an aspect of the present invention is an encoder that encodes a frequency spectral sequence on an individual frame, which is a predetermined time segment, basis. The encoder includes: a quantizer that obtains a quantized spectral sequence which is a sequence of integer values by dividing the frequency spectral values of the frequency spectral sequence by a quantization step size s; an integer transformer that obtains N' sets, each being made up of integer values, by combining a plurality of quantized spectra (p quantized spectra) contained in the quantized spectral sequence into a group in accordance with a predetermined rule and obtains a unified quantized spectral sequence of N' unified quantized spectra by obtaining one integer value for each of the N' sets, each being made up of integer values, by a bijective transformation; and an integer encoder that obtains an integer code by encoding each of the N' unified quantized spectra contained in the unified quantized spectral sequence using N' bit assignment values contained in a bit assignment sequence. The encoder further includes: an object-to-be-encoded estimator that obtains an estimated unified spectral sequence of N' estimated unified spectra from the frequency spectral sequence by a transformation that is the same as a transformation which is performed by the integer transformer or a transformation that approximates the magnitude relationship between values before and after the transformation which is performed by the integer transformer; a bit assigner that obtains the bit assignment sequence and a bit assignment code corresponding to the bit assignment sequence from the estimated unified spectral sequence; and a quantization step size obtainer that obtains the quantization step size s from the estimated unified spectral sequence and the bit assignment sequence.

Effects of the Invention

The present invention makes encoding and decoding with less distortion possible by performing efficient assignment of bit numbers even under a low bit rate condition.

DETAILED DESCRIPTION OF THE EMBODIMENTS

Figure 1:
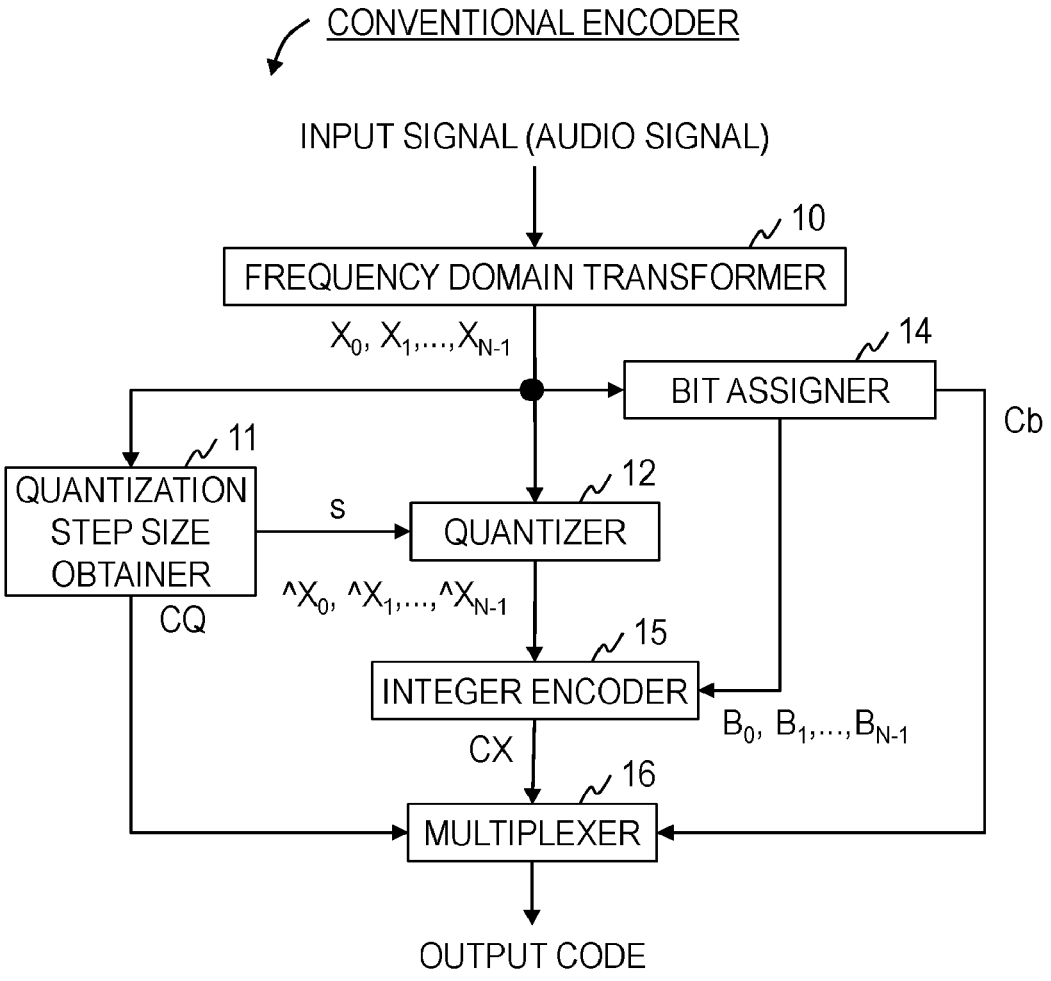
FIG. 1 is a diagram illustrating the functional configuration of a conventional encoder.
Figure 2:
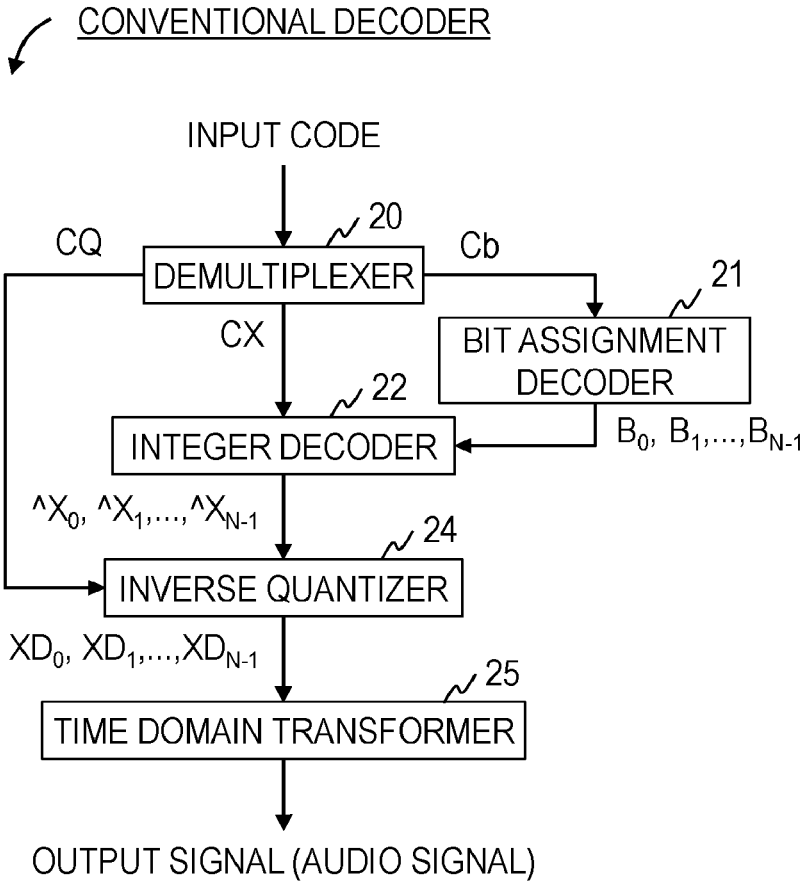
FIG. 2 is a diagram illustrating the functional configuration of a conventional decoder.

Hereinafter, embodiments of the present invention will be described in detail. It is to be noted that component units having the same function in the drawings are denoted by the same reference numeral and overlapping explanations are omitted.

Symbols "^" and "~" which are used in the text are supposed to be written directly above letters immediately following the symbols, but, due to a restriction imposed by text notation, they are written immediately before these letters. In formulae, these symbols are written in their proper positions, that is, directly above letters.

In the present invention, for a quantized spectral sequence whose samples are integer values, by unifying a plurality of quantized spectra into one integer value and performing bit assignment on the integer value after unification in an encoder, fine and efficient assignment of bit numbers to the samples contained in the quantized spectral sequence before unification is virtually achieved.

A bijective transformation that reversibly transforms a plurality of integer values to one integer value is used for unification of quantized spectra. In a decoder, by separating one integer value into a plurality of integer values by an inverse transformation that transforms one integer value to a plurality of integer values, a quantized spectral sequence is obtained.

First Embodiment

A system of a first embodiment of the present invention includes an encoder and a decoder. The encoder obtains a code by encoding a time domain audio signal input in units of frames of a predetermined time length and outputs the code. The code which is output from the encoder is input to the decoder. The decoder decodes the input code and outputs a frame-by-frame time domain audio signal. The audio signal which is input to the encoder is, for example, a speech signal or an acoustic signal obtained by collecting sound such as speech and music using a microphone and performing analog-to-digital conversion thereof. Moreover, the audio signal output from the decoder is made audible by being subjected to digital-to-analog conversion and reproduced through a loudspeaker, for example.

«Encoder»

Figure 3:
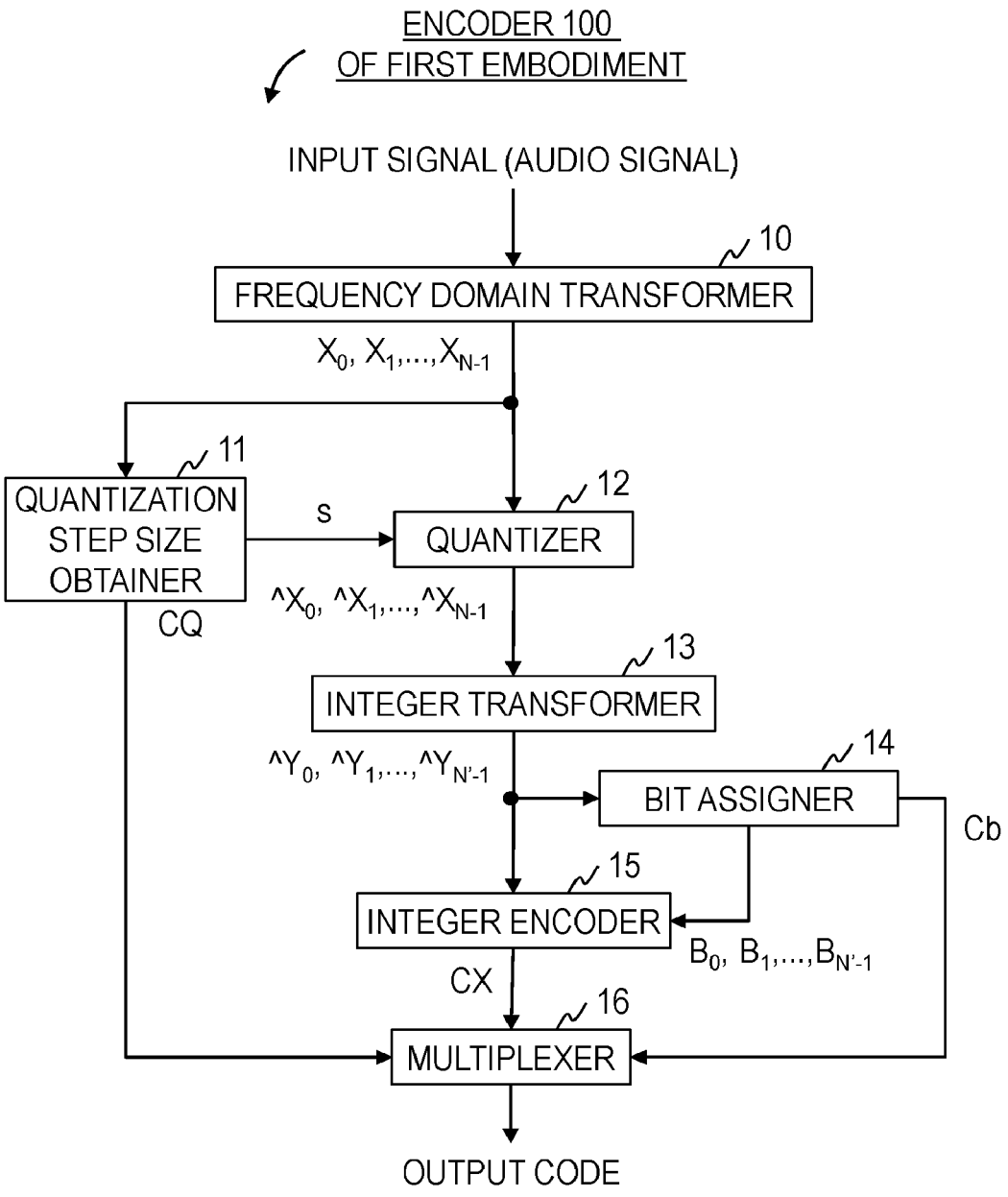
FIG. 3 is a diagram illustrating the functional configuration of an encoder of a first embodiment.
Figure 4:
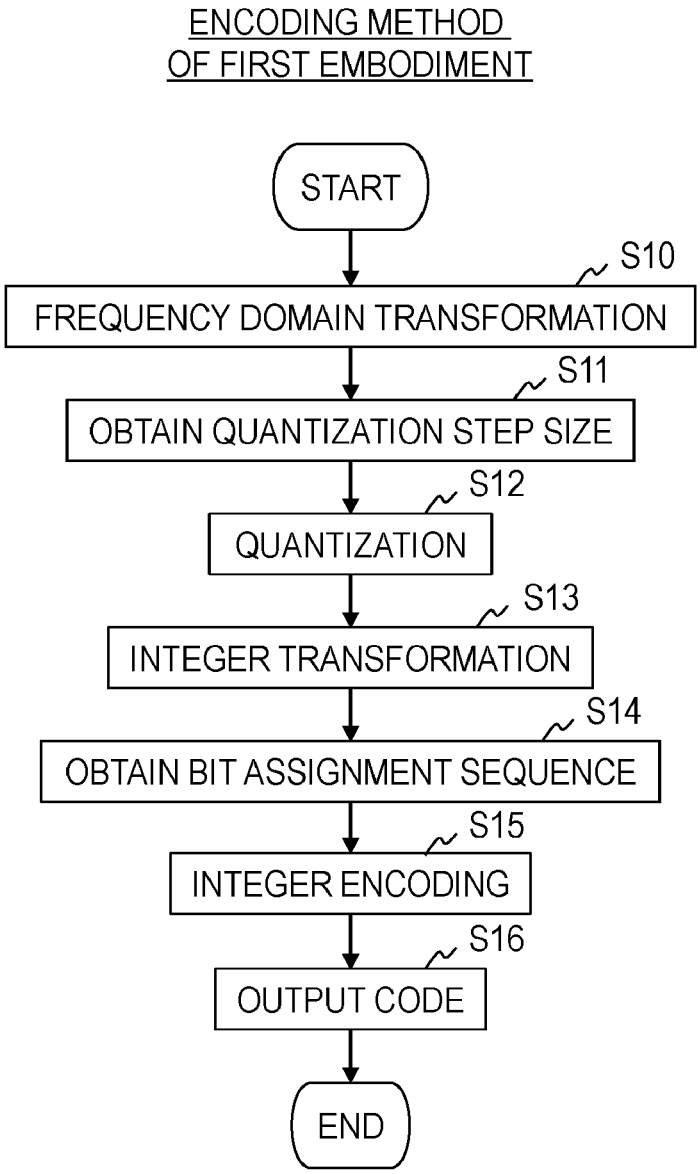
FIG. 4 is a diagram illustrating a processing procedure of an encoding method of the first embodiment.

A processing procedure of the encoder of the first embodiment will be described with reference to FIGS. 3 and 4. As illustrated in FIG. 3, an encoder 100 of the first embodiment includes a frequency domain transformer 10, a quantization step size obtainer 11, a quantizer 12, an integer transformer 13, a bit assigner 14, an integer encoder 15, and a multiplexer 16. The encoder 100 of the first embodiment implements an encoding method of the first embodiment by executing processing in steps shown in FIG. 4. A time domain audio signal input to the encoder 100 is input to the frequency domain transformer 10. The encoder 100 performs processing in each unit in units of frames of a predetermined time length.

It is to be noted that a frequency domain audio signal, not a time domain audio signal, may be input to the encoder 100. In this case, the encoder 100 does not have to include the frequency domain transformer 10 and only has to input, to the quantizer 12 and the quantization step size obtainer 11, a frequency domain audio signal which is input in units of frames of a predetermined time length.

[Frequency Domain Transformer 10]

The time domain audio signal input to the encoder 100 is input to the frequency domain transformer 10. The frequency domain transformer 10 transforms the input time domain audio signal to a frequency spectral sequence $X_0, X_1, \ldots, X_{N-1}$ of N points in the frequency domain by, for example, the modified discrete cosine transform (MDCT) or the like in units of frames of a predetermined time length, and outputs the frequency spectral sequence $X_0, X_1, \ldots, X_{N-}$(Step S10). N is a positive integer and, for example, a predetermined value, and N=32, for instance. Moreover, subscripts written below X are indexes assigned to spectra in the order of frequency from lowest to highest. As a method of transformation to the frequency domain, various publicly known transformation methods and the like (for example, the discrete Fourier transform, the short-time Fourier transform, and the like) which are not the MDCT may be used.

The frequency domain transformer 10 outputs the frequency spectral sequence $X_0, X_1, \ldots, X_{N-1}$ obtained by a transformation to the quantizer 12 and the quantization step size obtainer 11. It is to be noted that the frequency domain transformer 10 may perform filtering or companding on the frequency spectral sequence obtained by a transformation for perceptual weighting and output the sequence subjected to filtering or companding as the frequency spectral sequence $X_0, X_1, \ldots, X_{N-1}$.

[Quantization Step Size Obtainer 11]

The frequency spectral sequence $X_0, X_1, \ldots, X_{N-1}$ output from the frequency domain transformer 10 is input to the quantization step size obtainer 11. The quantization step size obtainer 11 outputs a quantization step size s, which is a value by which the input frequency spectral sequence $X_0$, $X_1, \ldots, X_{N-1}$ is divided, and a quantization step size code CQ corresponding to the quantization step size s (Step S11). The quantization step size obtainer 11 obtains the quantization step size s by a conventional method, for example, by determining, of already prepared candidates for the quantization step size, a quantization step size closest to a value which is, for example, proportional to the maximum value of the energy or amplitude of the input frequency spectral sequence $X_0, X_1, \ldots, X_{N-1}$ as the quantization step size s in the frame and outputs the obtained quantization step size s to the quantizer 12.

The quantization step size obtainer 11 obtains a code corresponding to the quantization step size s thus determined and outputs the obtained code to the multiplexer 16 as the quantization step size code CQ.

[Quantizer 12]

The frequency spectral sequence $X_0, X_1, \ldots, X_{N-1}$ output from the frequency domain transformer 10 and the quantization step size s output from the quantization step size obtainer 11 are input to the quantizer 12. The quantizer 12 obtains a quantized spectral sequence $\hat{X}_0, \hat{X}_1, \ldots, \hat{X}_{N-1}$, which is a sequence of the values of integer portions of the results obtained by dividing the frequency spectral values of the input frequency spectral sequence $X_0, X_1, \ldots, X_{N-1}$ by the quantization step size s, and outputs the quantized spectral sequence $\hat{X}_0, \hat{X}_1, \ldots, \hat{X}_{N-1}$ to the integer transformer 13 (Step S12).

[Integer Transformer 13]

The quantized spectral sequence $\hat{X}_0, \hat{X}_1, \ldots, \hat{X}_{N-1}$ output from the quantizer 12 is input to the integer transformer 13. The integer transformer 13 obtains, on the assumption that p is an integer greater than or equal to 2 and N' is a positive integer that makes the product of p and N' equal to N, N' integer sets, each being made up of p integer values, from the input quantized spectral sequence $\hat{X}_0, \hat{X}_1, \ldots, \hat{X}_{N-1}$ in accordance with a predetermined rule, obtains a unified quantized spectrum, which is one integer value, for each integer set by a bijective transformation, and outputs a unified quantized spectral sequence $\hat{Y}_0, \hat{Y}_1, \ldots, \hat{Y}_{N'-1}$, which is a sequence of the obtained N' integer values (that is, unified quantized spectra), to the bit assigner 14 and the integer encoder 15 (Step S13).

As a method of obtaining one integer value for each integer set by a bijective transformation, the following methods can be used: a method of obtaining one integer value for each integer set by an algebraically-representable bijective transformation, a method of obtaining one integer value for each integer set by referring to a mapping table, a method of obtaining one integer value for each integer set by a predetermined rule, and so forth. Moreover, one nonnegative integer value may be obtained as one integer value. It is to be noted that explanations of the bit assigner 14, the integer encoder 15, and a bit assignment decoder 21, an integer decoder 22, and the like of a decoder 200, which will be described later, are given on the assumption that the integer transformer 13 obtains one nonnegative integer value as one integer value.

As a method of obtaining one nonnegative integer value for each integer set by an algebraically-representable bijective transformation, when, for example, integer values that make up an integer set are two integer values $x_1$ and $x_2$ (that is, p=2), a method of obtaining one nonnegative integer value y by Formula (1) is used.

$$y = \max(x_1', x_2')^2 + 2\min(x_1', x_2') + a \begin{cases} \text{if } x_1' < x_2' & a = 1 \\ \text{otherwise} & a = 0 \end{cases} \tag{1}$$

Here, for an integer i=1, 2, $x'_i$ is assumed to be a nonnegative integer value that satisfies Formula (2) below for an integer value $x_i$.

$$\text{if}(x_i>0)\ x'_i=2|x_i|-1$$

$$\text{otherwise } x'_i=2|x_i| \tag{2}$$

The following methods may be adopted: a method of obtaining nonnegative integer values $x'_1$ and $x'_2$ by Formula (2) for the integer values $x_1$ and $x_2$ that make up an integer set and obtaining the nonnegative integer value y from a set made up of the obtained nonnegative integer values $x'_1$ and $x'_2$ by Formula (1) or a method of obtaining the nonnegative integer value y directly from an integer set by, for instance, a transformation formula obtained by combining Formula (1) and Formula (2).

Moreover, when, for example, integer values that make up an integer set are M integer values $x_1, x_2, \ldots, x_M$ (that is, p=M, where M is an integer greater than or equal to 2), a method of obtaining one nonnegative integer value y by Formula (3) is used.

$$y=f_M(x'_1,x'_2, \ldots ,x'_M) \tag{3}$$

Here, for an integer i=1, 2, . . . , M, $x'_i$ is assumed to be a nonnegative integer value that satisfies Formula (2) described above for an integer value $x_i$ and $f_{M'}(x'_1, x'_2, \ldots, x'_{M'})$ is a recursive function that receives a sequence (a variable sequence) $x'_1, x'_2, \ldots, x'_{M'}$ of M' variables as input and outputs one variable and is expressed as Formula (4) on the assumption that the maximum value of the M' variables $x'_1, x'_2, \ldots, x'_M$ is $x'_{max}$, the number of variables that take the maximum value is K, indexes of the K variables, which take the maximum value, in the variable sequence are $m_1, m_2, \ldots, m_K$, a sequence of M'-K variables, which is the variable sequence $x'_1, x'_2, \ldots, x'_M$ from which the variables that take the maximum value were removed, is $\sim x'_1, \sim x'_2, \ldots, \sim x'_{M'-K}$, $f_0$ is 0, and ${}_{M'}C_K$ is the number of combinations of selections of K variables from M' variables.

$$f_{M'}(x_1', x_2', \ldots, x_{M'}') = \sum_{m=0}^{K-1} {}_{M'}C_m x_{max}'^{M'-m} + {}_{M'}C_K f_{M'-K}(\tilde{x}_1', \tilde{x}_2', \ldots, \tilde{x}_{M'-K}') + \sum_{i=0}^{K-1} {}_{M'-m_{i+1}}C_{K-i} \tag{4}$$

The predetermined rule for obtaining the N' integer sets may be any rule as long as the rule is a rule that can be made in advance and stored in the encoder 100 and the decoder 200 in advance, such as a rule by which p adjacent integer values in the input quantized spectral sequence $\hat{X}_0, \hat{X}_1, \ldots, \hat{X}_{N-1}$ make up an integer set, that is, a rule by which integer values from $\hat{X}_0$ to $\hat{X}_{p-1}$, integer values from $\hat{X}_p$ to $\hat{X}_{2p-1}, \ldots$, and integer values from $\hat{X}_{N-p}$ to $\hat{X}_{N-1}$ each make up an integer set.

When the rule is a rule by which p adjacent integer values make up an integer set, the integer transformer 13 obtains a unified quantized spectrum $\hat{Y}_0$, which is one integer value, from an integer set made up of integer values from $\hat{X}_0$ to $\hat{X}_{p-1}$ of the input quantized spectral sequence $\hat{X}_0, \hat{X}_1, \ldots, \hat{X}_{N-1}$, obtains a unified quantized spectrum $\hat{Y}_1$, which is one integer value, from an integer set made up of integer values from $\hat{X}_p$ to $\hat{X}_{2p-1}$, . . . , and obtains a unified quantized spectrum $\hat{Y}_{N'-1}$, which is one integer value, from an integer set made up of integer values from $\hat{X}_{N-p}$ to $\hat{X}_{N-1}$, and outputs a unified quantized spectral sequence $\hat{Y}_0$, $\hat{Y}_1$, . . . , $\hat{Y}_{N'-1}$ which is a sequence of the obtained integer values (that is, unified quantized spectra).

The aim of the above-described transformation of an integer set to one integer is to more finely adjust an average bit number which is virtually assigned to each of the values of a quantized spectral sequence in encoding of a unified quantized spectral sequence, which is performed in a subsequent stage, by transforming a plurality of samples contained in the quantized spectral sequence to one sample. For instance, if one unified quantized spectral value obtained by transforming two quantized spectral values can be encoded with 1 bit, each of the two quantized spectra can be encoded with an average of ½ bit (half a bit). Moreover, for example, if one unified quantized spectral value obtained by transforming three quantized spectral values can be encoded with 5 bits, each of the three quantized spectra can be encoded with an average of 5/3 bits (five-thirds of a bit). That is, when a unified quantized spectrum obtained by transforming p quantized spectral values is encoded, although an assignment bit number is adjusted for each unified quantized spectrum in units of 1 bit in that encoding, an average bit number which is assigned to each quantized spectrum can be adjusted virtually in units of 1/p bit (one-pth of a bit), which makes it possible to perform finer bit assignment as compared with assigning a bit number to each of p quantized spectra. It is to be noted that, in the following description, the above-described transformation of an integer set to one integer is sometimes referred to as an integer transformation and an integer obtained by the transformation is sometimes referred to as a transformed integer.

The larger the number of integer values that make up the above-described integer set, the more finely an average bit number which is virtually assigned to a quantized spectrum can be adjusted; at the same time, however, the amount of computation needed for an integer transformation is also increased. Thus, the number p of integer values that make up the above-described integer set only has to be set in advance by a preliminary experiment or the like in view of these circumstances and stored in the encoder 100 and the decoder 200. Moreover, as described above, since N' is a number that makes the product of p and N' equal to N, as in the case of p, N' only has to be stored in the encoder 100 and the decoder 200 in advance.

[Bit Assigner 14]

The unified quantized spectral sequence $\hat{Y}_0$, $\hat{Y}_1$, . . . , $\hat{Y}_{N'-1}$ output from the integer transformer 13 is input to the bit assigner 14. The bit assigner 14 obtains, for example, a bit assignment sequence $B_0$, $B_1$, . . . , $B_{N'-1}$ of bit assignment values $B_0$, $B_1$, . . . , $B_{N'-1}$ corresponding to the unified quantized spectra of the unified quantized spectral sequence $\hat{Y}_0$, $\hat{Y}_1$, . . . , $\hat{Y}_{N'-1}$ and a bit assignment code Cb corresponding to the bit assignment sequence, and respectively outputs the obtained bit assignment sequence $B_0$, $B_1$, . . . , $B_{N'-1}$ and bit assignment code Cb to the integer encoder 15 and the multiplexer 16 (Step S14).

As an example of the bit assigner 14, an example thereof in a case where the integer encoder 15, which will be described later, is configured to obtain a signal code CX that represents a unified quantized log spectral sequence $L_0$, $L_1$, . . . , $L_{N'-1}$, which is a sequence of the base 2 logarithmic values of the unified quantized spectra of the unified quantized spectral sequence $\hat{Y}_0$ $\hat{Y}_1$, . . . , $\hat{Y}_{N'-1}$, will be described. For a plurality of candidates for a log spectral envelope sequence $LC_0$, $LC_1$, . . . , $LC_{N'-1}$ made up of N' integers, a set is stored in advance in an unillustrated storage in the bit assigner 14, the set being made up of a log spectral envelope sequence $LC_0$, $LC_1$, . . . , $LC_{N'-1}$ of each candidate, a spectral envelope sequence $HC_0$, $HC_1$, . . . , $HC_{N'-1}$ which is a sequence of powers of 2 whose exponents are the log spectral envelope values of the candidate, and a code corresponding to the candidate. That is, a plurality of sets are stored in advance in the unillustrated storage in the bit assigner 14, the plurality of sets each being made up of a candidate for the log spectral envelope sequence $LC_0$, $LC_1$, . . . , $LC_{N'-1}$, a candidate for the spectral envelope sequence $HC_0$, $HC_1$, . . . , $HC_{N'-1}$ corresponding to the candidate for the log spectral envelope sequence $LC_0$, $LC_1$, . . . , $LC_{N'-1}$, and a code by which the candidate for the log spectral envelope sequence $LC_0$, $LC_1$, . . . , $LC_{N'-1}$ can be identified. The bit assigner 14 selects, from the plurality of sets stored in the storage in advance, a set whose candidate for the spectral envelope sequence $HC_0$, $HC_1$, . . . , $HC_{N'-1}$ corresponds to the input unified quantized spectral sequence $\hat{Y}_0$, $\hat{Y}_1$, . . . , $\hat{Y}_{N'-1}$, outputs the candidate for the log spectral envelope sequence $LC_0$, $LC_1$, . . . , $LC_{N'-1}$ of the selected set as a bit assignment sequence $B_0$, $B_1$, . . . , $B_{N'-1}$, and obtains the code of the selected set as a bit assignment code Cb (a code representing bit assignment) and outputs the bit assignment code Cb.

For example, the bit assigner 14 obtains, for each of the candidates for the spectral envelope sequence $HC_0$, $HC_1$, . . . , $HC_{N'-1}$ which are stored in the storage, the energy of a sequence of ratios, each being obtained by dividing each unified quantized spectral value $\hat{Y}_k$ in the input unified quantized spectral sequence $\hat{Y}_0$, $\hat{Y}_1$, . . . , $\hat{Y}_{N'-1}$ by a corresponding spectral envelope value $HC_k$ in the candidate for the spectral envelope sequence $HC_0$, $HC_1$, . . . , $HC_{N'-1}$, and outputs a bit assignment sequence $B_0$, $B_1$, . . . , $B_{N'-1}$, which is a candidate for the log spectral envelope sequence $LC_0$, $LC_1$, . . . , $LC_{N'-1}$ corresponding to a candidate for the spectral envelope sequence $HC_0$, $HC_1$, . . . , $HC_{N'-1}$ by which the smallest energy is obtained, and a bit assignment code Cb.

The signal code CX which is obtained by the integer encoder 15, which will be described later, by encoding the unified quantized spectral sequence $\hat{Y}_0$, $\hat{Y}_1$, . . . , $\hat{Y}_{N'-1}$ is made up of codes $CX_0$, $CX_1$, . . . , $CX_{N'-1}$ which are binary numbers of the numbers of digits of the unified quantized log spectral values of the unified quantized log spectral sequence $L_0$, $L_1$, . . . , $L_{N'-1}$ which is a sequence of the base 2 logarithmic values of the unified quantized spectra of the unified quantized spectral sequence $\hat{Y}_0$, $\hat{Y}_1$, . . . , $\hat{Y}_{N'-1}$. A candidate for the spectral envelope sequence $HC_0$, $HC_1$, . . . , $HC_{N'-1}$ of the set selected by the bit assigner 14 corresponds to the input unified quantized spectral sequence $\hat{Y}_0$, $\hat{Y}_1$, . . . , $\hat{Y}_{N'-1}$, which means that a candidate for the log spectral envelope sequence $LC_0$, $LC_1$, . . . , $LC_{N'-1}$ of the set selected by the bit assigner 14 corresponds to the unified quantized log spectral sequence $L_0$, $L_1$, . . . , $L_{N'-1}$. Therefore, the bit assigner 14 respectively outputs a candidate for the log spectral envelope sequence $LC_0$, $LC_1$, . . . , $LC_{N'-1}$ of the selected set as a bit assignment sequence $B_0$, $B_1$, . . . , $B_{N'-1}$ and a code of the selected set as a bit assignment code Cb.

It is to be noted that only one of a log spectral envelope sequence $LC_0$, $LC_1$, . . . , $LC_{N'-1}$ of each candidate and a spectral envelope sequence $HC_0$, $HC_1$, . . . , $HC_{N'-1}$, which is a sequence of powers of 2 whose exponents are the log spectral envelope values of the candidate, may be stored in the storage and the other may be calculated in the bit assigner 14.

[Integer Encoder 15]

The unified quantized spectral sequence $\hat{Y}_0, \hat{Y}_1, \ldots, \hat{Y}_{N'-1}$ output from the integer transformer 13 and the bit assignment sequence $B_0, B_1, \ldots, B_{N'-1}$ output from the bit assigner 14 are input to the integer encoder 15. The integer encoder 15 obtains codes $CX_0, CX_1, \ldots, C_{N'-1}$ corresponding to the values of the unified quantized spectral sequence $\hat{Y}_0, \hat{Y}_1, \ldots, \hat{Y}_{N'-1}$ by encoding the values of the unified quantized spectral sequence $\hat{Y}_0, \hat{Y}_1, \ldots, \hat{Y}_{N'-1}$ so as to obtain codes with bit numbers of the bit assignment values, which corresponds to the values of the unified quantized spectral sequence $\hat{Y}_0, \hat{Y}_1, \ldots, Y_{N'-1}$, of the bit assignment sequence $B_0, B_1, \ldots, B_{N'-1}$ and outputs a signal code CX, into which all the obtained codes $CX_0, CX_1, \ldots, CX_{N'-1}$ are combined, to the multiplexer 16 (Step S15).

The integer encoder 15 obtains, for example, codes representing the unified quantized spectral values of the unified quantized spectral sequence $\hat{Y}_0, \hat{Y}_1, \ldots, \hat{Y}_{N'-1}$ as binary numbers and obtains codes $CX_0, CX_1, \ldots, CX_{N'-1}$ by putting the obtained codes in the corresponding bit numbers represented by the bit assignment sequence $B_0, B_1, \ldots, B_{N'-1}$, and obtains a signal code CX, into which all the codes $CX_0, CX_1, \ldots, CX_{N'-1}$ are combined, and outputs the signal code CX. That is, the integer encoder 15 performs encoding such that, for example, if a bit assignment value $B_k$ in the bit assignment sequence $B_0, B_1, \ldots, B_{N'-1}$ is 5, the integer encoder 15 obtains, as a code $CX_k$, a code representing a corresponding unified quantized spectral value $\hat{Y}_k$ in the input unified quantized spectral sequence $\hat{Y}_0, \hat{Y}_1, \ldots, \hat{Y}_{N'-1}$ as a 5-digit binary number.

[Multiplexer 16]

The multiplexer 16 receives the quantization step size code CQ output from the quantization step size obtainer 11, the bit assignment code Cb output from the bit assigner 14, and the signal code CX output from the integer encoder 15 and outputs an output code containing all of these codes, for example, an output code obtained by concatenating the quantization step size code CQ, the bit assignment code Cb, and the signal code CX (Step S16).

«Decoder»

Figure 5:
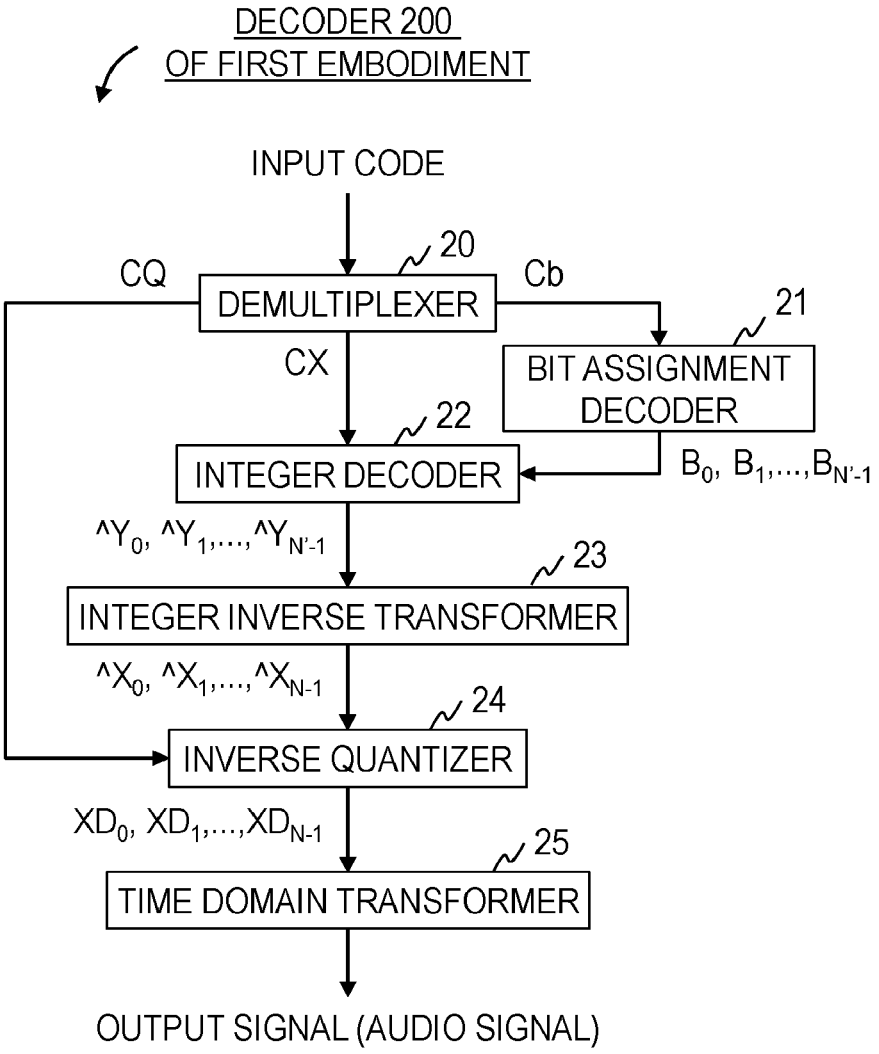
FIG. 5 is a diagram illustrating the functional configuration of a decoder of the first embodiment.
Figure 6:
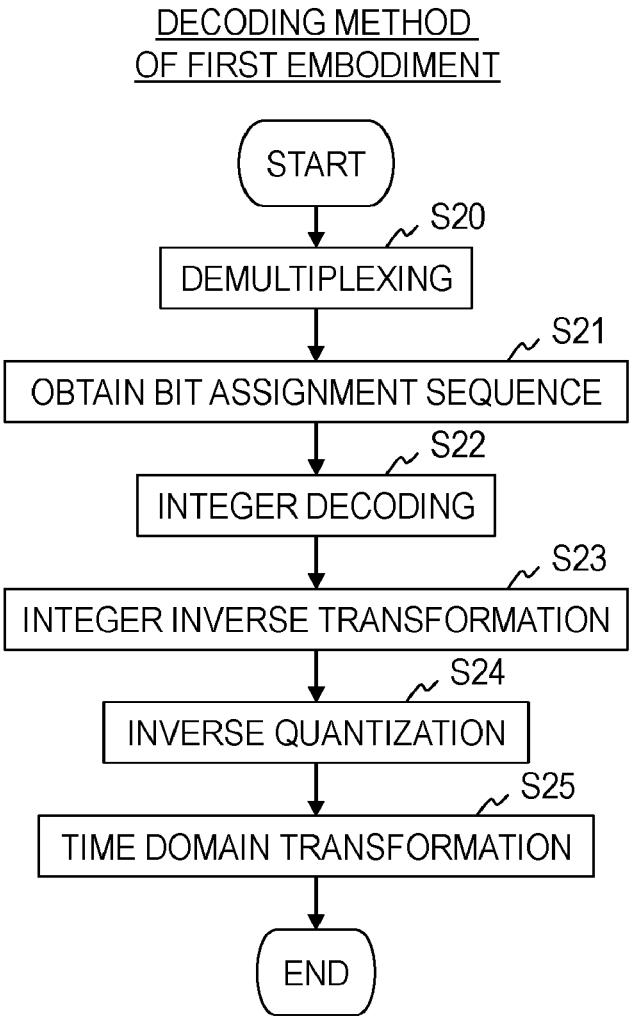
FIG. 6 is a diagram illustrating a processing procedure of a decoding method of the first embodiment.

A processing procedure of the decoder of the first embodiment will be described with reference to FIGS. 5 and 6. As illustrated in FIG. 5, the decoder 200 of the first embodiment includes a demultiplexer 20, a bit assignment decoder 21, an integer decoder 22, an integer inverse transformer 23, an inverse quantizer 24, and a time domain transformer 25. The decoder 200 of the first embodiment implements a decoding method of the first embodiment by executing processing in steps shown in FIG. 6. The code output from the encoder 100 is input to the decoder 200. That is, the output code output from the encoder 100 is input to the decoder 200 as an input code. The input code input to the decoder 200 is input to the demultiplexer 20. The decoder 200 performs processing in each unit in units of frames of a predetermined time length.

[Demultiplexer 20]

The input code input to the decoder 200 is input to the demultiplexer 20. The demultiplexer 20 receives the input code on a frame-by-frame basis, separates the input code into the bit assignment code Cb, the quantization step size code CQ, and the signal code CX, and respectively outputs the bit assignment code Cb contained in the input code to the bit assignment decoder 21, the quantization step size code CQ contained in the input code to the inverse quantizer 24, and the signal code CX contained in the input code to the integer decoder 22 (Step S20).

[Bit Assignment Decoder 21]

For a plurality of candidates, which are the same as those stored in the unillustrated storage of the bit assigner 14 of the corresponding encoder 100, for the log spectral envelope sequence $LC_0, LC_1, \ldots, LC_{N'-1}$ made up of N' integers, a set made up of a log spectral envelope sequence $LC_0, LC_1, \ldots, LC_{N'-1}$ of each candidate and a code corresponding to the sequence is stored in advance in an unillustrated storage in the bit assignment decoder 21. That is, a plurality of sets, each being made up of a candidate for the log spectral envelope sequence $LC_0, LC_1, \ldots, LC_{N'-1}$ and a code by which the candidate for the log spectral envelope sequence $LC_0, LC_1, \ldots, LC_{N'-1}$ can be identified, are stored in advance in the unillustrated storage in the bit assignment decoder 21. The bit assignment code Cb output from the demultiplexer 20 is input to the bit assignment decoder 21. The bit assignment decoder 21 retrieves a candidate for the log spectral envelope sequence $LC_0, LC_1, \ldots, LC_{N'-1}$, which corresponds to the input bit assignment code Cb, from the storage, obtains the retrieved candidate for the log spectral envelope sequence $LC_0, LC_1, \ldots, LC_{N'-1}$ as a bit assignment sequence $B_0, B_1, \ldots, B_{N'-1}$, and outputs the obtained bit assignment sequence $B_0, B_1, \ldots, B_{N'-1}$ to the integer decoder 22 (Step S21). That is, the bit assignment decoder 21 selects, from the plurality of sets stored in the storage in advance, a set whose code corresponds to the bit assignment code Cb, obtains a candidate for the log spectral envelope sequence of the selected set as a bit assignment sequence $B_0, B_1, \ldots, B_{N'-1}$, and outputs the obtained bit assignment sequence $B_0, B_1, \ldots, B_{N'-1}$ to the integer decoder 22.

While at least one of a log spectral envelope sequence $LC_0, LC_1, \ldots, LC_{N'-1}$ of each candidate and a spectral envelope sequence $HC_0, HC_1, \ldots, HC_{N'-1}$, which is a sequence of powers of 2 whose exponents are the log spectral envelope values of the candidate, is stored in the unillustrated storage of the bit assigner 14 of the corresponding encoder 100, the bit assignment decoder 21 of the decoder 200 does not have to store the spectral envelope sequence $HC_0, HC_1, \ldots, HC_{N'-1}$ because the spectral envelope sequence $HC_0, HC_1, \ldots, HC_{N'-1}$ is not used therein and the bit assignment decoder 21 only has to store a set made up of a log spectral envelope sequence $LC_0, LC_1, \ldots, LC_{N-1}$ and a code corresponding to the sequence.

[Integer Decoder 22]

The signal code CX output from the demultiplexer 20 and the bit assignment sequence $B_0, B_1, \ldots, B_{N'-1}$ output from the bit assignment decoder 21 are input to the integer decoder 22. The integer decoder 22 separates the signal code CX into codes $CX_0, CX_1, \ldots, CX_{N'-1}$ with bit numbers represented by the bit assignment values of the bit assignment sequence $B_0, B_1, \ldots, B_{N'-1}$, obtains a decoded unified quantized spectral sequence $\hat{Y}_0, \hat{Y}_1, \ldots, \hat{Y}_N$, by decoding the codes $CX_0, CX_1, \ldots, CX_{N'-1}$, and outputs the obtained decoded unified quantized spectral sequence $\hat{Y}_0, \hat{Y}_1, \ldots, \hat{Y}_{N'-1}$ to the integer inverse transformer 23 (Step S22).

The integer decoder 22 obtains, for example, a decoded unified quantized spectral sequence $\hat{Y}_0, \hat{Y}_1, \ldots, \hat{Y}_{N'-1}$ whose decoded unified quantized spectral values are binary numbers represented by the codes $CX_0, CX_1, \ldots, CX_{N'-1}$ and outputs the decoded unified quantized spectral sequence $\hat{Y}_0, \hat{Y}_1, \ldots, \hat{Y}_{N'-1}$ That is, the integer decoder 22 performs decoding such that, for example, if a bit assignment value $B_k$ in the bit assignment sequence $B_0, B_1, \ldots, B_{N'-1}$ is 5, the integer decoder 22 obtains, as a decoded unified quantized spectral value $\hat{Y}_k$, a value obtained by transforming a corresponding 5-bit code $CX_k$ in the input signal code CX to a 5-digit binary number.

[Integer Inverse Transformer 23]

The decoded unified quantized spectral sequence $\hat{Y}_0, \hat{Y}_1, \ldots, \hat{Y}_{N'-1}$ output from the integer decoder 22 is input to the integer inverse transformer 23. The integer inverse transformer 23 obtains N' integer sets, each being made up of p integer values, by performing, on each of the integer values contained in the input decoded unified quantized spectral sequence $\hat{Y}_0, \hat{Y}_1, \ldots, \hat{Y}_{N'-1}$, a transformation which is the inverse transformation of the transformation performed by the integer transformer 13 of the encoder 100 of the first embodiment, and obtains a decoded quantized spectral sequence $\hat{X}_0, \hat{X}_1, \ldots, \hat{X}_{N-1}$ from the obtained N' integer sets in accordance with a rule corresponding to the rule which the integer transformer 13 of the encoder 100 of the first embodiment follows and outputs the decoded quantized spectral sequence $\hat{X}_0, \hat{X}_1, \ldots, \hat{X}_{N-1}$ (Step S23).

When the integer transformer 13 of the encoder 100 of the first embodiment performed a transformation by Formula (1) and Formula (2), the integer inverse transformer 23 obtains integer values $x_1$ and $x_2$ by processing, as a transformation which is the inverse transformation of the transformation by Formula (1) and Formula (2), by which two nonnegative integer values $x'_1$ and $x'_2$ are obtained from one nonnegative integer value y by Formula (5) and, for an integer i=1, 2, an integer value $x_i$ with a plus or minus sign is obtained from a nonnegative integer value $x'_i$ by Formula (6) below.

$$\begin{aligned} &\text{if } y-\lfloor\sqrt{y}\rfloor^2 \text{ is even} \\ &x'_1=\lfloor\sqrt{y}\rfloor \\ &x'_2=\frac{(y-\lfloor\sqrt{y}\rfloor^2)}{2} \\ &\text{otherwise} \end{aligned} \tag{5}$$

$$\begin{aligned} &x'_1=\frac{(y-\lfloor\sqrt{y}\rfloor^2-1)}{2} \\ &x'_2=\lfloor\sqrt{y}\rfloor \\ &\text{if } (x'_i \text{ is odd}) \quad x_i=(x'_i+1)/2 \\ &\text{otherwise} \quad x_i=-x'_1/2 \end{aligned} \tag{6}$$

Here, in Formula (5), $$\lfloor\sqrt{y}\rfloor$$

is a floor function of the square root of y, that is, the largest integer that does not exceed the square root of y.

Moreover, when the integer transformer 13 of the encoder 100 of the first embodiment performed a transformation by Formula (3) and Formula (2), the integer inverse transformer 23 uses, as a transformation which is the inverse transformation of the transformation by Formula (3) and Formula (2), a transformation that obtains integer values $x_1, x_2, \ldots, x_M$ by processing to obtain M nonnegative integer values $x'_1, x'_2, \ldots, x'_M$ from one nonnegative integer value y by Formula (7) and, for an integer i=1, 2, . . . , M, an integer value $x_i$ with a plus or minus sign from a nonnegative integer value $x'_i$ by Formula (6) described above.

$$(x'_1, x'_2, \ldots, x'_M)=f_M^{-1}(y) \tag{7}$$

Here, $f_M^{-1}(y)$ is a recursive function that receives one variable as input and outputs M' variables, and obtains M' nonnegative integer values $x'_1, x'_2, \ldots, x'_{M'}$ by calculating Formula (8) using $i_1=0$ and $i_2=0$ as initial values for each case from m=0 to m=M'−1 by using the maximum M'th-order square root that does not exceed y $$\left\lfloor \sqrt[M']{y} \right\rfloor,$$

the maximum K that does not make $$y-\sum_{m=0}^{K-1} {}_{M'}C_m \left\lfloor \sqrt[M']{y} \right\rfloor^{M'-m}$$

less than 0, a variable sequence $\sim x'_1, \sim x'_2, \ldots, \sim x'_{M'-K}$ of M'-K variables, which is obtained by $$f_{M'-K}^{-1}\left(\left\lfloor\left(y-\sum_{m=0}^{K-1} {}_{M'}C_m \left\lfloor \sqrt[M']{y} \right\rfloor^{M'-m}\right) \Big/ {}_{M'}C_K\right\rfloor\right),$$

and $\lambda_{M'}$ which is a remainder left over after dividing $$y-\sum_{m=0}^{K-1} {}_{M'}C_m \left\lfloor \sqrt[M']{y} \right\rfloor^{M'-m}$$

by ${}_{M'}C_K$ and outputs the M' nonnegative integer values $x'_1, x'_2, \ldots, x'_{M'}$.

$$\begin{aligned} &\text{if } \lambda_{M'} \geq {}_{M'-m-1}C_{K-i_1} \\ &x'_{m+1}=\left\lfloor \sqrt[M']{y} \right\rfloor \\ &\lambda_{M'}=\lambda_{M'}-{}_{M'-m-1}C_{K-i_1} \\ &i_1=i_1+1 \\ &\text{otherwise} \\ &x'_{m+1}=\tilde{x}'_{i_2+1} \\ &i_2=i_2+1 \end{aligned} \tag{8}$$

Moreover, $f_0^{-1}(y)$ means a function that produces no output.

[Inverse Quantizer 24]

The quantization step size code CQ output from the demultiplexer 20 and the decoded quantized spectral sequence $\hat{X}_0, \hat{X}_1, \ldots, \hat{X}_{N-1}$ output from the integer inverse transformer 23 are input to the inverse quantizer 24. The inverse quantizer 24 obtains a quantization step size s by decoding the input quantization step size code CQ. Moreover, the inverse quantizer 24 obtains a decoded frequency spectral sequence $XD_0, XD_1, \ldots, XD_{N-1}$, which is a sequence of values obtained by multiplying the decoded quantized spectral values of the input decoded quantized spectral sequence $\hat{X}_0, \hat{X}_1, \ldots, \hat{X}_{N-1}$ by the quantization step size s obtained by decoding and outputs the decoded frequency spectral sequence $XD_0, XD_1, \ldots, XD_{N-1}$ to the time domain transformer 25 (Step S24).

[Time Domain Transformer 25]

The decoded frequency spectral sequence $XD_0, XD_1, \ldots, XD_{N-1}$ output from the inverse quantizer 24 is input to the time domain transformer 25.

The time domain transformer 25 obtains a frame-by-frame audio signal (decoded audio signal) by transforming the decoded frequency spectral sequence $XD_0, XD_1, \ldots, XD_{N-1}$ to a time domain signal on a frame-by-frame basis using a method of transformation to the time domain, such as the inverse MDCT, which corresponds to the method of transformation to the frequency domain performed by the frequency domain transformer 10 of the encoder 100, and outputs the audio signal (decoded audio signal) (Step S25).

It is to be noted that, when filtering or companding for perceptual weighting was performed on the frequency spectral sequence, which was obtained by a transformation, in the frequency domain transformer 10 of the encoder 100, the time domain transformer 25 outputs a decoded audio signal obtained by transforming, to a time domain signal, the decoded frequency spectral sequence subjected to inverse filtering or inverse companding corresponding to the above processing.

The decoder 200 may output a frequency domain decoded audio signal, not a time domain decoded audio signal. In this case, the decoder 200 does not have to include the time domain transformer 25 and only has to concatenate the frame-by-frame decoded frequency spectral sequences obtained by the inverse quantizer 24 in the order of time segment and output the result thus obtained as a frequency domain decoded audio signal.

Modification of the First Embodiment

The encoder 100 of the first embodiment obtains the signal code CX by encoding, which is performed in the integer encoder 15, of the unified quantized spectral sequence obtained by performing quantization (division) using the quantization step size s obtained before quantization of the frequency spectral sequence $X_0, X_1, \ldots, X_{N-1}$ and then performing an integer transformation. In the encoder 100 of the first embodiment, the integer encoder 15 obtains a code representing each unified quantized spectral value $\hat{Y}_k$ as a binary number, which sometimes results in a situation where, depending on the unified quantized spectral value $\hat{Y}_k$, a bit number of the obtained code exceeds a bit assignment value $B_k$, that is, an assumed upper limit bit number. This makes it impossible for the corresponding decoder 200 to perform decoding correctly. In that case, the encoder can perform quantization and encoding again after increasing the quantization step size, so that a bit number of a code which is obtained by the integer encoder is made smaller and does not exceed a bit assignment value $B_k$; however, too large a quantization step size results in too coarse quantization, which leads to a reduction in the accuracy of a decoded signal. That is, it is preferable that the encoder uses the smallest quantization step size that does not allow a bit number of a code which is obtained by the integer encoder to exceed a bit assignment value. For this reason, an encoder 101 of a modification of the first embodiment obtains an optimum quantization step size by repeatedly performing quantization, an integer transformation, and encoding in each frame and adjusting and updating the quantization step size each time.

Figure 7:
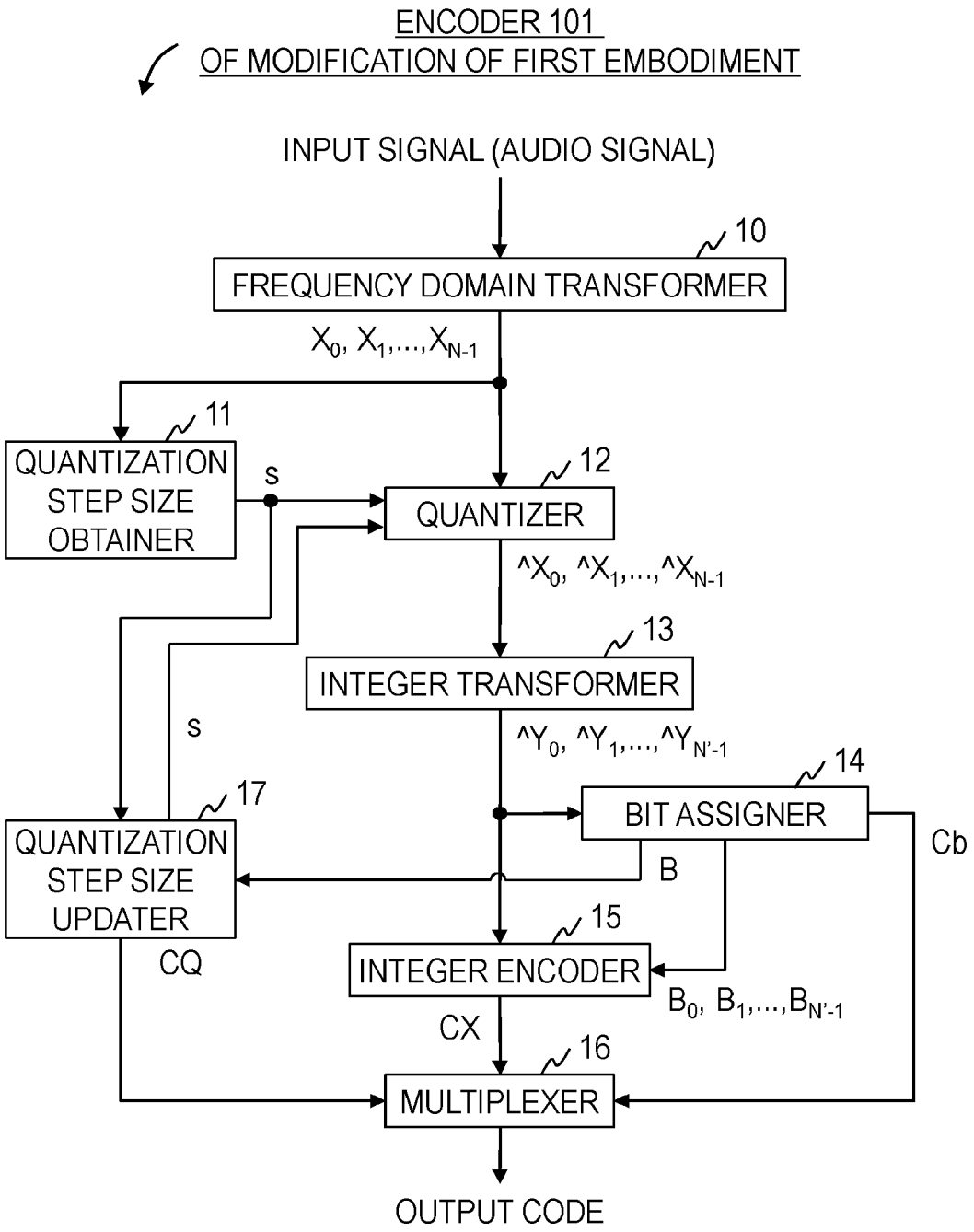
FIG. 7 is a diagram illustrating the functional configuration of an encoder of a modification of the first embodiment.
Figure 8:
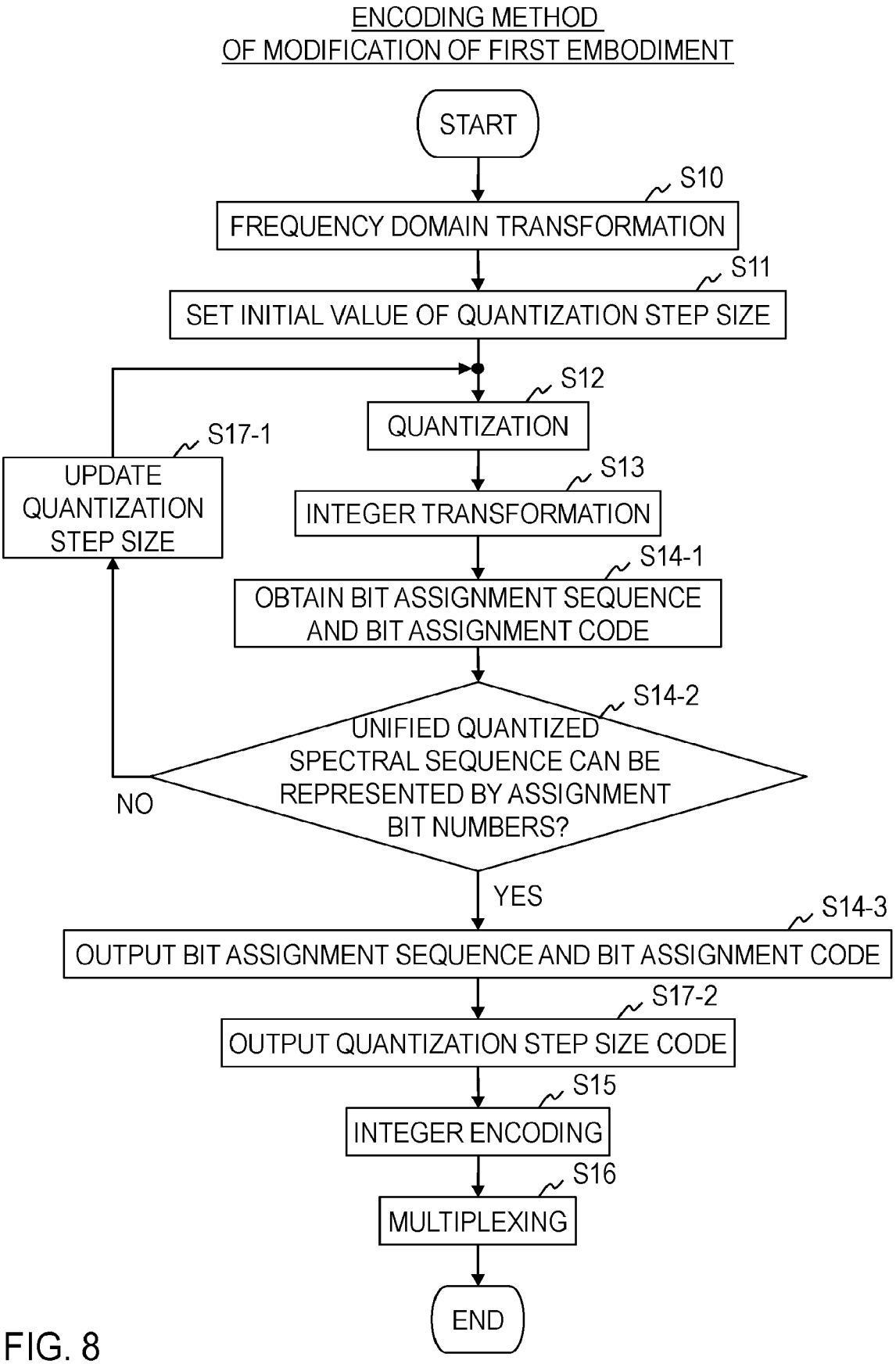
FIG. 8 is a diagram illustrating a processing procedure of an encoding method of the modification of the first embodiment.

A processing procedure of the encoder 101 of the modification of the first embodiment will be described with reference to FIGS. 7 and 8. As illustrated in FIG. 7, the encoder 101 of the modification of the first embodiment includes a quantization step size updater 17 in addition to the configuration of the encoder 100 of the first embodiment and, as illustrated in FIG. 8, repeatedly performs processing in the quantizer 12, the integer transformer 13, the bit assigner 14, and the quantization step size updater 17. Hereinafter, only a difference from the encoder 100 of the first embodiment will be described.

[Quantization Step Size Obtainer 11 of the Modification]

The quantization step size obtainer 11 of the modification obtains a quantization step size s in the same manner as the quantization step size obtainer 11 of the first embodiment and outputs the obtained quantization step size s to the quantizer 12 and the quantization step size updater 17. This quantization step size s is the initial value of the quantization step size that is used in processing which is performed by the quantizer 12 (Step S11).

[Quantizer 12 of the Modification]

The quantizer 12 of the modification obtains, in the same manner as the quantizer 12 of the first embodiment, a quantized spectral sequence $\hat{X}_0, \hat{X}_1, \ldots, \hat{X}_{N-1}$, which is a sequence of the values of integer portions of the results obtained by dividing the frequency spectral values of the input frequency spectral sequence $X_0, X_1, \ldots, X_{N-1}$ by the quantization step size s, using the frequency spectral sequence $X_0, X_1, \ldots, X_{N-1}$ output from the frequency domain transformer 10 and the quantization step size s output from the quantization step size obtainer 11 or the quantization step size updater 17, and outputs the quantized spectral sequence $\hat{X}_0, \hat{X}_1, \ldots, \hat{X}_{N-1}$ to the integer transformer 13 (Step S12). The quantization step size s which is used when the quantizer 12 is executed for the first time in each frame is the quantization step size s obtained by the quantization step size obtainer 11, that is, the initial value of the quantization step size. Moreover, the quantization step size s which is used when the quantizer 12 is executed for the second and subsequent times is the quantization step size s obtained by the quantization step size updater 17, that is, the updated value of the quantization step size.

[Bit Assigner 14 of the Modification]

The bit assigner 14 of the modification first obtains a bit assignment sequence $B_0, B_1, \ldots, B_{N'-1}$ corresponding to the unified quantized spectra of the input unified quantized spectral sequence $\hat{Y}_0, \hat{Y}_1, \ldots, \hat{Y}_{N'-1}$ and a bit assignment code Cb corresponding to the bit assignment sequence by the same processing as that performed by the bit assigner 14 of the first embodiment (Step S14-1).

Next, the bit assigner 14 judges whether or not the values of the unified quantized spectral sequence $\hat{Y}_0, \hat{Y}_1, \ldots, \hat{Y}_{N'-1}$ are within the range of values that can be represented by $B_0, B_1, \ldots, B_{N'-1}$ bits which are bit numbers assigned to the values of the unified quantized spectral sequence $\hat{Y}_0, \hat{Y}_1, \ldots, \hat{Y}_{N'-1}$ (Step S14-2). Specifically, the bit assigner 14 judges whether or not none of the base 2 logarithmic values of the unified quantized spectra of the unified quantized spectral sequence $\hat{Y}_0, \hat{Y}_1, \ldots, \hat{Y}_{N'-1}$ exceeds a corresponding bit assignment value in the bit assignment sequence $B_0, B_1, \ldots, B_{N'-1}$. If the bit assigner 14 judges that none of the base 2 logarithmic values of the unified quantized spectra of the unified quantized spectral sequence $\hat{Y}_0, \hat{Y}_1, \ldots, \hat{Y}_{N'-1}$ exceeds a corresponding bit assignment value in the bit assignment sequence $B_0, B_1, \ldots, B_{N'-1}$, that is, judges that the values of the unified quantized spectral sequence $\hat{Y}_0, \hat{Y}_1, \ldots, \hat{Y}_{N'-1}$ are within the range of values that can be represented by $B_0, B_1, \ldots, B_{N'-1}$ bits which are bit numbers assigned to the values of the unified quantized spectral sequence $\hat{Y}_0, \hat{Y}_1, \ldots, \hat{Y}_{N'-1}$ and the number of updates of the quantization step size is greater than or equal to a predetermined number of updates (YES in Step S14-2), the bit assigner 14 outputs the bit assignment sequence $B_0, B_1, \ldots, B_{N'-1}$, outputs the bit assignment code Cb to the multiplexer 16, and outputs, to the quantization step size updater 17, an instruction signal that instructs the quantization step size updater 17 to output, to the multiplexer 16, a quantization step size code CQ, which is a code corresponding to the quantization step size obtained by the quantization step size updater 17 (Step S14-3). Otherwise, the bit assigner 14 obtains, as a maximum shortage bit number B, the maximum value in a sequence of values, each being a value obtained by subtracting each of the values of the bit assignment sequence $B_0, B_1, \ldots, B_{N'-1}$, which correspond to the base 2 logarithmic values of the unified quantized spectral sequence $\hat{Y}_0, \hat{Y}_1, \ldots, \hat{Y}_{N'-1}$, from a corresponding base 2 logarithmic value, and outputs the maximum shortage bit number B to the quantization step size updater 17 (NO in Step S14-2). Here, the base 2 logarithmic values of the unified quantized spectral sequence $\hat{Y}_0, \hat{Y}_1, \ldots, \hat{Y}_{N'-1}$ are bit numbers of codes which are obtained by the integer encoder 15 by encoding the values of the unified quantized spectral sequence $\hat{Y}_0, \hat{Y}_1, \ldots, \hat{Y}_{N'-1}$.

[Quantization Step Size Updater 17]

The quantization step size updater 17 receives the maximum shortage bit number B output from the bit assigner 14. If B is positive, that is, if there is a shortage of bit numbers to be assigned to the unified quantized spectral sequence $\hat{Y}_0, \hat{Y}_1, \ldots, \hat{Y}_{N'-1}$, the quantization step size updater 17 updates the value of the quantization step size s to a larger value; if B is negative, that is, if there is a surplus of bit numbers to be assigned to the unified quantized spectral sequence $\hat{Y}_0, \hat{Y}_1, \ldots, \hat{Y}_{N'-1}$, the quantization step size updater 17 updates the value of the quantization step size s to a smaller value. Then, the quantization step size updater 17 increments the number of updates of the quantization step size and outputs the value of the updated quantization step size s (the updated value of the quantization step size s) to the quantizer 12 (Step S17-1).

Moreover, if an instruction signal that instructs the quantization step size updater 17 to output a quantization step size code CQ to the multiplexer 16 is input to the quantization step size updater 17 from the bit assigner 14, the quantization step size updater 17 obtains a code corresponding to the quantization step size s and outputs the obtained code to the multiplexer 16 as a quantization step size code CQ (Step S17-2).

Second Embodiment

The above-described encoder 101 of the modification of the first embodiment can perform encoding with less quantization distortion by determining the value of the quantization step size by repeatedly obtaining, in the quantization step size updater 17, the minimum value of the quantization step size by which, in the integer encoder 15, the unified quantized spectral sequence $\hat{Y}_0, \hat{Y}_1, \ldots, \hat{Y}_{N'-1}$ can be represented by the bit numbers set in the bit assigner 14. However, in this case, the processing in the quantizer 12, the bit assigner 14, and the integer transformer 13 has to be performed more than once, which may require a larger amount of computation. The processing in the quantizer 12, the bit assigner 14, and the integer transformer 13 has to be performed more than once because, only after the quantizer 12 quantizes the frequency spectral sequence $X_0, X_1, \ldots, X_{N-1}$, a unified quantized spectral sequence $\hat{Y}_0, \hat{Y}_1, \ldots, \hat{Y}_{N'-1}$ obtained by a transformation of a quantized spectral sequence $\hat{X}_0, \hat{X}_1, \ldots, \hat{X}_{N-1}$, which is a sequence of the integer values of the frequency spectral sequence $X_0, X_1, \ldots, X_{N-1}$ after quantization, is obtained. Thus, an encoder of a second embodiment determines the value of an appropriate quantization step size without performing processing in a bit assigner and an integer transformer more than once by determining a quantization step size in a quantization step size obtainer concurrently with bit assignment by the bit assigner by using an object-to-be-encoded estimator that estimates, before quantization, the shape of a unified quantized spectral sequence $\hat{Y}_0, \hat{Y}_1, \ldots, \hat{Y}_{N'-1}$ which can be input to an integer encoder, that is, the general magnitude relationship in the unified quantized spectral sequence.

As in the case of the system of the first embodiment, a system of the second embodiment of the present invention includes an encoder and a decoder. It is to be noted that only the encoder of the second embodiment is different from the encoder of the first embodiment and the decoder of the second embodiment is the same as the decoder of the first embodiment.

«Encoder»

Figure 9:
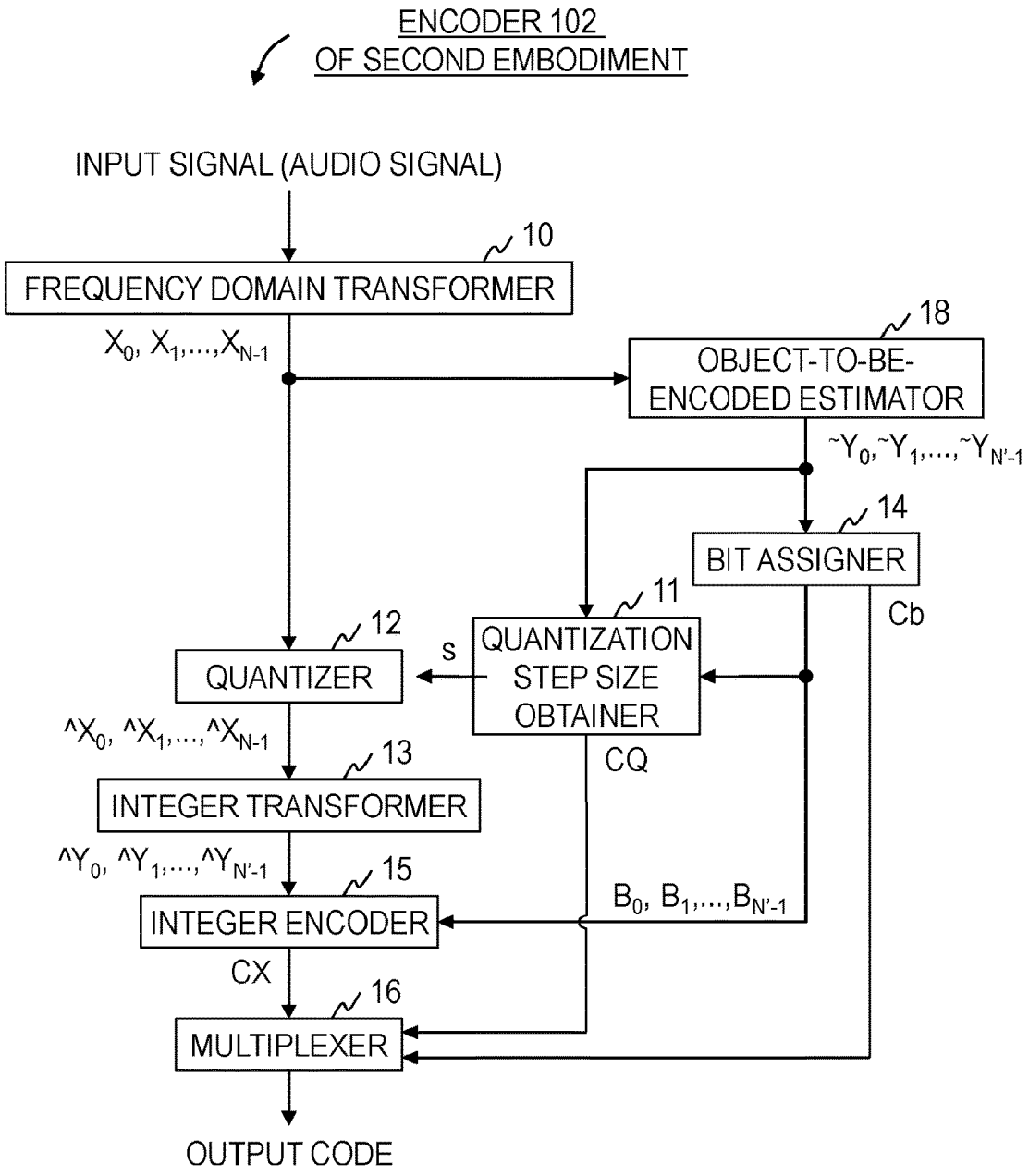
FIG. 9 is a diagram illustrating the functional configuration of an encoder of a second embodiment.
Figure 10:
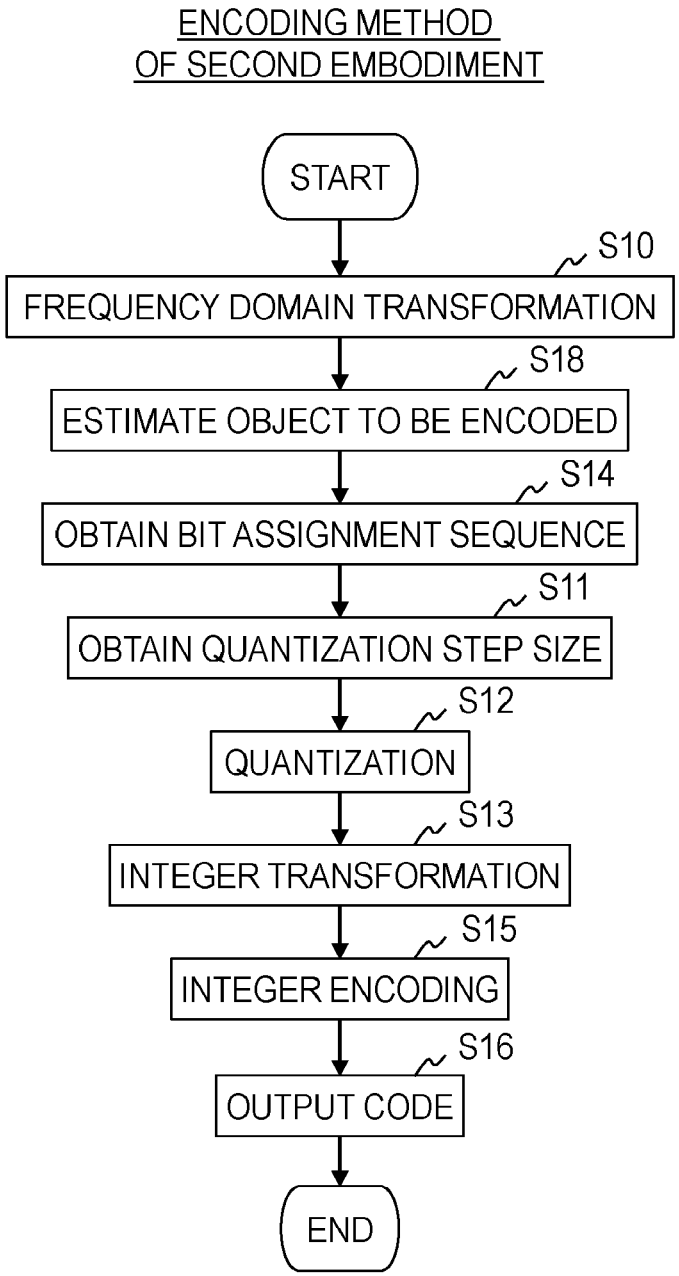
FIG. 10 is a diagram illustrating a processing procedure of an encoding method of the second embodiment.

A processing procedure of the encoder of the second embodiment will be described with reference to FIGS. 9 and 10. As illustrated in FIG. 9, an encoder 102 of the second embodiment includes a frequency domain transformer 10, an object-to-be-encoded estimator 18, a quantization step size obtainer 11, a quantizer 12, an integer transformer 13, a bit assigner 14, an integer encoder 15, and a multiplexer 16. The encoder 102 of the second embodiment of FIG. 9 differs from the encoder 100 of the first embodiment of FIG. 3 in that the encoder 102 includes the object-to-be-encoded estimator 18, the frequency domain transformer 10 also outputs a frequency spectral sequence to the object-to-be-encoded estimator 18, the bit assigner 14 operates using the output of the object-to-be-encoded estimator 18 as input, and the quantization step size obtainer 11 operates using the outputs of the object-to-be-encoded estimator 18 and the bit assigner 14 as input. The operation of the other configuration of the encoder 102 of the second embodiment, that is, the quantizer 12, the integer transformer 13, and the integer encoder 15 is the same as that of the encoder 100 of the first embodiment. Hereinafter, only a difference from the encoder 100 of the first embodiment will be described.

[Frequency Domain Transformer 10 of the Second Embodiment]

The frequency domain transformer 10 of the second embodiment operates in the same manner as the frequency domain transformer 10 of the encoder 100 of the first embodiment and differs therefrom only in an output destination. The frequency domain transformer 10 transforms the time domain audio signal input to the encoder 102 to a frequency spectral sequence $X_0, X_1, \ldots, X_{N-1}$ of N points in the frequency domain in units of frames and outputs the frequency spectral sequence $X_0, X_1, \ldots, X_{N-1}$ to the quantizer 12 and the object-to-be-encoded estimator 18 (Step S10). As in the case of the first embodiment, N is assumed to be expressed as the product of predetermined positive numbers p and N'.

[Object-to-be-Encoded Estimator 18]

The frequency spectral sequence $X_0, X_1, \ldots, X_{N-1}$ output from the frequency domain transformer 10 is input to the object-to-be-encoded estimator 18. The object-to-be-encoded estimator 18 obtains N' integer sets, each being made up of p integer values, from the input frequency spectral sequence $X_0, X_1, \ldots, X_{N-1}$ in accordance with the rule which the integer transformer 13 follows, obtains, for each integer set, an estimated unified spectrum, which is one integer value, by a transformation that is the same as a bijective transformation which is performed by the integer transformer 13 or a transformation that approximates the magnitude relationship between values before and after the above transformation, and outputs an estimated unified spectral sequence $\sim Y_0, \sim Y_1, \ldots, \sim Y_{N'-1}$, which is a sequence of the obtained N' integer values (that is, estimated unified spectra), to the bit assigner 14 and the quantization step size obtainer 11 (Step S18). When the object-to-be-encoded estimator 18 performs a transformation that is the same as a transformation which is performed by the integer transformer 13, the object-to-be-encoded estimator 18 uses, for example, a transformation by Formula (1) and Formula (2) or a transformation by Formulae (2) to (4), which is the same as a transformation that is performed by the integer transformer 13, as a method of obtaining one integer value for each integer set by an algebraically-representable bijective transformation, for instance. Moreover, since the values of the first terms of Formula (1) and Formula (4), that is, the terms in which the input is raised to the p-th power are dominant and, when obtaining a quantization step size, the important thing is that the shape of a unified quantized spectral sequence $\hat{Y}_0, \hat{Y}_1, \ldots, \hat{Y}_{N'-1}$, that is, the magnitude relationship between the values of the unified quantized spectra in a unified quantized spectral sequence $\hat{Y}_0, \hat{Y}_1, \ldots, \hat{Y}_{N'-1}$, which is obtained by an integer transformation of a quantized spectral sequence $\hat{X}_0, \hat{X}_1, \ldots, \hat{N}_{N-1}$, is obtained, when the integer transformer 13 performs a transformation by Formula (1) and Formula (2), a transformation which is performed in the object-to-be-encoded estimator 18 may use, as a transformation that is not bijective but approximates the magnitude relationship between values before and after the transformation which is performed by the integer transformer 13, a formula obtained by modifying Formula (1) to include only the first term on the right side thereof in place of Formula (1). Likewise, when the integer transformer 13 performs a transformation by Formulae (2) to (4), a transformation which is performed in the object-to-be-encoded estimator 18 may use, as a transformation that approximates the magnitude relationship between values before and after the transformation which is performed by the integer transformer 13, a formula obtained by modifying Formula (4) to include only the first term on the right side thereof in place of Formula (4).

As described above, the object-to-be-encoded estimator 18 estimates the shape of a unified quantized spectral sequence $\hat{Y}_0, \hat{Y}_1, \ldots, \hat{Y}_{N'-1}$ by obtaining an estimated unified spectral sequence $\sim Y_0, \sim Y_1, \ldots, \sim Y_{N'-1}$ by performing, on the frequency spectral sequence $X_0, X_1, \ldots, X_{N-1}$, a transformation that is the same as a transformation which is performed by the integer transformer 13 or a transformation that approximates the magnitude relationship between values before and after the transformation which is performed by the integer transformer 13, and uses the shape as a clue to assignment of bits and estimation of the value of an appropriate quantization step size.

[Bit Assigner 14 of the Second Embodiment]

The estimated unified spectral sequence $\sim Y_0, \sim Y_1, \ldots, \sim Y_{N'-1}$ output from the object-to-be-encoded estimator 18 is input to the bit assigner 14 of the second embodiment. The bit assigner 14 obtains, for example, a bit assignment sequence $B_0, B_1, \ldots, B_{N'-1}$, which is a sequence of bit assignment values $B_0, B_1, \ldots, B_{N'-1}$ corresponding to the estimated unified spectra of the estimated unified spectral sequence $\sim Y_0, \sim Y_1, \ldots, Y_{N'-1}$, and a bit assignment code Cb corresponding to the bit assignment sequence, outputs the obtained bit assignment sequence $B_0, B_1, \ldots, B_{N'-1}$ to the integer encoder 15 and the quantization step size obtainer 11, and outputs the obtained bit assignment code Cb to the multiplexer 16 (Step S14).

As an example of the bit assigner 14, as in the case of the first embodiment, an example thereof in a case where the integer encoder 15 is configured to obtain a signal code CX that represents a unified quantized log spectral sequence $L_0, L_1, \ldots, L_{N'-1}$, which is a sequence of the base 2 logarithmic values of the unified quantized spectra of the unified quantized spectral sequence $\hat{Y}_0, \hat{Y}_1, \ldots, \hat{Y}_{N'-1}$, will be described.

For a plurality of candidates for a log spectral envelope sequence $LC_0, LC_1, \ldots, LC_{N'-1}$ made up of N integers, a set is stored in advance in an unillustrated storage in the bit assigner 14, the set being made up of a log spectral envelope sequence $LC_0, LC_1, \ldots, LC_{N'-1}$ of each candidate, a spectral envelope sequence $HC_0, HC_1, \ldots, HC_{N'-1}$ which is a sequence of powers of 2 whose exponents are the log spectral envelope values of the candidate, and a code corresponding to the candidate. That is, a plurality of sets are stored in advance in the unillustrated storage in the bit assigner 14, the plurality of sets each being made up of a candidate for the log spectral envelope sequence $LC_0, LC_1, \ldots, LC_{N'-1}$, a candidate for the spectral envelope sequence $HC_0, HC_1, \ldots, HC_{N'-1}$ corresponding to the candidate for the log spectral envelope sequence $LC_0, LC_1, \ldots, LC_{N'-1}$, and a code by which the candidate for the log spectral envelope sequence $LC_0, LC_1, \ldots, LC_{N'-1}$ can be identified. The bit assigner 14 selects, from the plurality of sets stored in the storage in advance, a set whose candidate for the spectral envelope sequence $HC_0, HC_1, \ldots, HC_{N'-1}$ corresponds to the input estimated unified spectral sequence $\sim Y_0, \sim Y_1, \ldots, \sim Y_{N'-1}$, outputs the candidate for the log spectral envelope sequence $LC_0, LC_1, \ldots, LC_{N'-1}$ of the selected set as a bit assignment sequence $B_0, B_1, \ldots, B_{N'-1}$, and obtains the code of the selected set as a bit assignment code Cb (a code representing bit assignment) and outputs the bit assignment code Cb.

For example, the bit assigner 14 obtains, for each of the candidates for the spectral envelope sequence $HC_0, HC_1, \ldots, HC_{N'-1}$ which are stored in the storage, the energy of a sequence of ratios, each being obtained by dividing each estimated unified spectral value $\sim Y_k$ in the input estimated unified spectral sequence $\sim Y_0, \sim Y_1, \ldots, \sim Y_{N'-1}$ by a corresponding spectral envelope value $HC_k$ in the candidate for the spectral envelope sequence $HC_0, HC_1, \ldots, HC_{N'-1}$, and outputs a bit assignment sequence $B_0, B_1, \ldots, B_{N'-1}$, which is a candidate for the log spectral envelope sequence $LC_0, LC_1, \ldots, LC_{N'-1}$ corresponding to a candidate for the spectral envelope sequence $HC_0, HC_1, \ldots, HC_{N'-1}$ by which the smallest energy is obtained, and a bit assignment code Cb.

The signal code CX which is obtained by the integer encoder 15 by encoding the unified quantized spectral sequence $\hat{Y}_0, \hat{Y}_1, \ldots, \hat{Y}_{N'-1}$ is a code into which codes $CX_0, CX_1, \ldots, CX_{N'-1}$, which are binary numbers of the numbers of digits of the unified quantized log spectral values of the unified quantized log spectral sequence $L_0, L_1, \ldots, L_{N'-1}$ which is a sequence of the base 2 logarithmic values of the unified quantized spectra of the unified quantized spectral sequence $\hat{Y}_0, \hat{Y}_1, \ldots, \hat{Y}_{N'-1}$, are combined.

It is to be noted that only one of a log spectral envelope sequence $LC_0, LC_1, \ldots, LC_{N'-1}$ of each candidate and a spectral envelope sequence $HC_0, HC_1, \ldots, HC_{N'-1}$, which is a sequence of powers of 2 whose exponents are the log spectral envelope values of the candidate, may be stored in the storage and the other may be calculated in the bit assigner 14.

[Quantization Step Size Obtainer 11 of the Second Embodiment]

The estimated unified spectral sequence $\sim Y_0, \sim Y_1, \ldots, \sim Y_{N'-1}$ output from the object-to-be-encoded estimator 18 and the bit assignment sequence $B_0, B_1, \ldots, B_{N'-1}$ output from the bit assigner 14 are input to the quantization step size obtainer 11 of the second embodiment. The quantization step size obtainer 11 obtains, from the estimated unified spectral sequence $\sim Y_0, \sim Y_1, \ldots, \sim Y_{N'-1}$ and the bit assignment sequence $B_0, B_1, \ldots, B_{N'-1}$, a quantization step size s and a quantization step size code CQ which is a code corresponding to the quantization step size s, and respectively outputs the obtained quantization step size s and quantization step size code CQ to the quantizer 12 and the multiplexer 16 (Step S11).

The quantization step size obtainer 11 obtains a quantization step size s from the estimated unified spectral sequence $\sim Y_0, \sim Y_1, \ldots, \sim Y_{N'-1}$ and the bit assignment sequence $B_0, B_1, \ldots, B_{N'-1}$ in the following manner, for example. The quantization step size obtainer 11 first divides each of the values of the estimated unified spectral sequence $\sim Y_0, \sim Y_1, \ldots, \sim Y_{N'-1}$ by a corresponding value of the spectral envelope sequence $H_0, H_1, \ldots, H_{N'-1}$, which is a sequence of powers of 2 whose exponents are the bit assignment values of the bit assignment sequence $B_0, B_1, \ldots, B_{N'-1}$ and obtains a sequence of the division results. The amplitude of each of the values of the sequence of the division results indicates the times by which a corresponding value of the estimated unified spectral sequence $\sim Y_0, \sim Y_1, \ldots, \sim Y_{N'-1}$ deviates from the range of values that can be represented by bit assignment in accordance with the bit assignment sequence $B_0, B_1, \ldots, B_{N'-1}$. Moreover as described above, since the value of the term in which the input is raised to the p-th power is dominant in an integer transformation which is performed in the integer transformer 13, the value of each estimated unified spectrum of the estimated unified spectral sequence $\sim Y_0, \sim Y_1, \ldots, \sim Y_{N'-1}$ is about the same as the value obtained by raising the value of a corresponding frequency spectrum of the frequency spectral sequence $X_0, X_1, \ldots, X_{N-1}$ to the p-th power. Therefore, the quantization step size obtainer 11 obtains, for example, the maximum value of the amplitudes of the division results contained in the sequence of the division results and determines the p-th root of the obtained maximum value as a quantization step size s. Then, the quantization step size obtainer 11 obtains a code corresponding to the quantization step size s thus determined and outputs the obtained code to the multiplexer 16 as a quantization step size code CQ.

It is to be noted that, in place of the p-th root of the maximum value of the amplitudes of the division results contained in the sequence of the division results, a value that is slightly greater than the p-th root of the maximum value may be used. For instance, the p-th root of a value obtained by adding a predetermined positive number to the maximum value of the amplitudes of the division results contained in the sequence of the division results or the p-th root of a value obtained by multiplying the maximum value by a predetermined number which is greater than 1 may be determined as a quantization step size s. Moreover, a value obtained by adding a predetermined positive number to the p-th root of the maximum value of the amplitudes of the division results contained in the sequence of the division results or a value obtained by multiplying the p-th root of the maximum value of the amplitudes of the division results contained in the sequence of the division results by a predetermined number which is greater than 1 may be determined as a quantization step size s. That is, the quantization step size obtainer 11 only has to determine, as a quantization step size s, a value which is greater than or equal to and close to the p-th root of the maximum value of the amplitudes of the division results contained in the sequence of the division results.

[Multiplexer 16 of the Second Embodiment]

The multiplexer 16 of the second embodiment receives the quantization step size code CQ output from the quantization step size obtainer 11, the bit assignment code Cb output from the bit assigner 14, and the signal code CX output from the integer encoder 15, and outputs an output code containing all of these codes (for example, an output code obtained by concatenating all the codes) (Step S16).

While the embodiments of the present invention have been described, specific configurations are not limited to these embodiments, but design modifications and the like within a range not departing from the spirit of the invention are encompassed in the scope of the invention, of course. The various processes described in the embodiments may be executed in parallel or separately depending on the processing ability of an apparatus executing the process or on any necessity, rather than being executed in time series in accordance with the described order.

[Program and Recording Medium]

When various types of processing functions in the apparatuses described in the above embodiments are implemented on a computer, the contents of processing function to be contained in each apparatus is written by a program. With this program executed on the computer, various types of processing functions in the above-described apparatuses are implemented on the computer.

This program in which the contents of processing are written can be recorded in a computer-readable recording medium. The computer-readable recording medium may be any medium such as a magnetic recording device, an optical disk, a magneto-optical recording medium, and a semiconductor memory.

Distribution of this program is implemented by sales, transfer, rental, and other transactions of a portable recording medium such as a DVD and a CD-ROM on which the program is recorded, for example. Furthermore, this program may be stored in a storage of a server computer and transferred from the server computer to other computers via a network so as to be distributed.

A computer which executes such program first stores the program recorded in a portable recording medium or transferred from a server computer once in a storage thereof, for example. When the processing is performed, the computer reads out the program stored in the storage thereof and performs processing in accordance with the program thus read out. As another execution form of this program, the computer may directly read out the program from a portable recording medium and perform processing in accordance with the program. Furthermore, each time the program is transferred to the computer from the server computer, the computer may sequentially perform processing in accordance with the received program. Alternatively, a configuration may be adopted in which the transfer of a program to the computer from the server computer is not performed and the above-described processing is executed by so-called application service provider (ASP)-type service by which the processing functions are implemented only by an instruction for execution thereof and result acquisition. It should be noted that a program in this form includes information which is provided for processing performed by electronic calculation equipment and which is equivalent to a program (such as data which is not a direct instruction to the computer but has a property specifying the processing performed by the computer).

In this form, the present apparatus is configured with a predetermined program executed on a computer. However, the present apparatus may be configured with at least part of these processing contents realized in a hardware manner.

What is claimed is:

1. An encoder that encodes a frequency spectral sequence on an individual frame, which is a predetermined time segment, basis, the encoder comprising processing circuitry configured to:

execute a quantizer processing that obtains a quantized spectral sequence which is a sequence of integer values by dividing frequency spectral values of the frequency spectral sequence by a quantization step size s;

execute an integer transformer processing that obtains N' sets, each being made up of integer values, by combining a plurality of quantized spectra (p quantized spectra) contained in the quantized spectral sequence into a group in accordance with a predetermined rule and obtains a unified quantized spectral sequence of N' unified quantized spectra by obtaining one integer value (hereinafter referred to as a "transformed integer") for each of the N' sets, each being made up of integer values, by a bijective transformation; and execute an integer encoder processing that obtains an integer code by encoding each of the N' unified quantized spectra contained in the unified quantized spectral sequence using N' bit assignment values contained in a bit assignment sequence;

execute an object-to-be-encoded estimator processing that obtains an estimated unified spectral sequence of N' estimated unified spectra from the frequency spectral sequence by a transformation that is the same as a transformation which is performed by the integer transformer processing or a transformation that approximates a magnitude relationship between values before and after the transformation which is performed by the integer transformer processing;

execute a bit assigner processing that obtains the bit assignment sequence and a bit assignment code corresponding to the bit assignment sequence from the estimated unified spectral sequence; and execute a quantization step size obtainer processing that obtains the quantization step size s from the estimated unified spectral sequence and the bit assignment sequence.

2. The encoder according to claim 1, wherein the bit assigner processing obtains, of a plurality of candidates for the bit assignment sequence, a candidate corresponding to a sequence, which is a sequence of powers of 2 whose exponents are bit assignment values of a bit assignment sequence, whose shape is closest to a shape of the estimated unified spectral sequence as the bit assignment sequence, and the quantization step size obtainer processing obtains a sequence of division results by dividing each estimated unified spectral value of the estimated unified spectral sequence by a value of a power of 2 whose exponent is a bit assignment value, which corresponds to the estimated unified spectral value, of the bit assignment sequence, and determines a value which is greater than or equal to and close to a p-th root of a maximum value of amplitudes of values of the sequence of the division results as the quantization step size s.

3. An encoding method of encoding a frequency spectral sequence on an individual frame, which is a predetermined time segment, basis, the encoding method comprising:

a quantization step in which a quantizer obtains a quantized spectral sequence which is a sequence of integer values by dividing frequency spectral values of the frequency spectral sequence by a quantization step size s;

an integer transformation step in which an integer transformer obtains N' sets, each being made up of integer values, by combining a plurality of quantized spectra (p quantized spectra) contained in the quantized spectral sequence into a group in accordance with a predetermined rule and obtains a unified quantized spectral sequence of N' unified quantized spectra by obtaining one integer value (hereinafter referred to as a "transformed integer") for each of the N' sets, each being made up of integer values, by a bijective transformation; and an integer encoding step in which an integer encoder obtains an integer code by encoding each of the N' unified quantized spectra contained in the unified quantized spectral sequence using N' bit assignment values contained in a bit assignment sequence, wherein the encoding method further comprises:

an object-to-be-encoded estimation step in which an object-to-be-encoded estimator obtains an estimated unified spectral sequence of N' estimated unified spectra from the frequency spectral sequence by a transformation that is the same as a transformation which is performed in the integer transformation step or a transformation that approximates a magnitude relationship between values before and after the transformation which is performed in the integer transformation step;

a bit assignment step in which a bit assigner obtains the bit assignment sequence and a bit assignment code corresponding to the bit assignment sequence from the estimated unified spectral sequence; and a quantization step size obtaining step in which a quantization step size obtainer obtains the quantization step size s from the estimated unified spectral sequence and the bit assignment sequence.

4. The encoding method according to claim 3, wherein the bit assignment step obtains, of a plurality of candidates for the bit assignment sequence, a candidate corresponding to a sequence, which is a sequence of powers of 2 whose exponents are bit assignment values of a bit assignment sequence, whose shape is closest to a shape of the estimated unified spectral sequence as the bit assignment sequence, and the quantization step size obtaining step obtains a sequence of division results by dividing each estimated unified spectral value of the estimated unified spectral sequence by a value of a power of 2 whose exponent is a bit assignment value, which corresponds to the estimated unified spectral value, of the bit assignment sequence, and determines a value which is greater than or equal to and close to a p-th root of a maximum value of amplitudes of values of the sequence of the division results as the quantization step size s.

5. A non-transitory computer-readable recording medium on which a program for making a computer execute each step of the encoding method according to claim 3 or 4 is recorded.

6. The encoding method according to claim 1 or 2, wherein the integer transformation processing obtains, on an assumption that M is the number of integer values contained in the set made up of integer values, $x_1, x_2, \ldots, x_M$ are integer values contained in the set made up of integer values, and $x'_i$ is a nonnegative integer value that satisfies the following formula in terms of the integer value $x_i$ $$\text{if}(x_i>0)\ x'_i=2|x_i|-1$$

$$\text{otherwise}\ x'_i=2|x_i|,$$

a transformed integer y, which is the one integer value, by calculating the following formula $$y=f_M(x'_1,x'_2,\ldots,x'_M),\ \text{and}$$

a function $f_{M'}$ which is used in the above formula is a recursive function that calculates the following formula $$f_{M'}(x'_1, x'_2, \ldots, x'_{M'}) = \sum_{m=0}^{K-1} {}_{M'}C_m x'^{M'-m}_{max} + {}_{M'}C_K f_{M'-K}(\tilde{x}'_1, \tilde{x}'_2, \ldots, \tilde{x}'_{M'-K}) + \sum_{i=0}^{K-1} {}_{M'-m_{i+1}}C_{K-i}$$

on an assumption that $x'_{max}$ is a maximum value of $x'_1, x'_2, \ldots, x'_{M'}$, K is the number of integer values, of $x'_1, x'_2, \ldots, x'_{M'}$, which take the maximum value, $m_1, m_2, \ldots, m_K$ are indexes of the integer values, of $x'_1, x'_2, \ldots, x'_{M'}$, which take the maximum value, $\sim x'_1, \sim x'_2, \ldots, \sim x'_{M'-K}$ are integer values of $x'_1, x'_2, \ldots, x'_{M'}$ from which the K integer values that take the maximum value were removed, ${}_aC_b$ is the number of combinations of selections of b integer values from a integer values, and $f_0$ is 0.

7. The encoding method according to claim 3 or 4, wherein the integer transformation step obtains, on an assumption that M is the number of integer values contained in the set made up of integer values, $x_i, x_2, \ldots, x_M$ are integer values contained in the set made up of integer values, and $x'_i$ is a nonnegative integer value that satisfies the following formula in terms of the integer value $x_i$ $$\text{if}(x_i>0)\ x'_i=2|x_i|-1$$

$$\text{otherwise}\ x'_i=2|x_i|,$$

a transformed integer y, which is the one integer value, by calculating the following formula $$y=f_M(x'_1,x'_2,\ldots,x'_M),\ \text{and}$$

a function $f_{M'}$ which is used in the above formula is a recursive function that calculates the following formula $$f_{M'}(x'_1, x'_2, \ldots, x'_{M'}) = \sum_{m=0}^{K-1} {}_{M'}C_m x'^{M'-m}_{max} + {}_{M'}C_K f_{M'-K}(\tilde{x}'_1, \tilde{x}'_2, \ldots, \tilde{x}'_{M'-K}) + \sum_{i=0}^{K-1} {}_{M'-m_{i+1}}C_{K-i}$$

on an assumption that $x'_{max}$ is a maximum value of $x'_1, x'_2, \ldots, x'_{M'}$, K is the number of integer values, of $x'_1, x'_2, \ldots, x'_{M'}$, which take the maximum value, $m_1, m_2, \ldots, m_K$ are indexes of the integer values, of $x'_1, x'_2, \ldots, x'_{M'}$, which take the maximum value, $\sim x'_1, \sim x'_2, \ldots, \sim x'_{M'-K}$ are integer values of $x'_1, x'_2, \ldots, x'_{M'}$ from which the K integer values that take the maximum value were removed, ${}_aC_b$ is the number of combinations of selections of b integer values from a integer values, and $f_0$ is 0.

* * * * *